US007812539B2

(12) United States Patent
Cha et al.

(10) Patent No.: US 7,812,539 B2
(45) Date of Patent: Oct. 12, 2010

(54) FILTER AND PLASMA DISPLAY DEVICE THEREOF

(75) Inventors: Hong Rae Cha, Seoul (KR); Ji Hoon Sohn, Seoul (KR); Joon Kwon Moon, Seoul (KR); Woon Seo Shin, Seoul (KR); Eun Seong Seo, Seoul (KR); Ki Hoon Song, Seoul (KR); Jeong Ho Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 12/035,693

(22) Filed: Feb. 22, 2008

(65) Prior Publication Data

US 2009/0026951 A1 Jan. 29, 2009

(30) Foreign Application Priority Data

Jul. 24, 2007 (KR) ..... 10-2007-0074042

(51) Int. Cl.
*H01J 17/49* (2006.01)

(52) U.S. Cl. ..... 313/587; 313/112; 313/582; 359/350; 359/885; 359/891

(58) Field of Classification Search ..... None
See application file for complete search history.

(56) References Cited

U.S. PATENT DOCUMENTS

| | | | | |
|---|---|---|---|---|
| 7,339,319 | B2 * | 3/2008 | Hirota et al. | 313/582 |
| 7,679,275 | B2 * | 3/2010 | Park et al. | 313/112 |
| 2008/0030134 | A1 * | 2/2008 | Ryu et al. | 313/582 |
| 2009/0167173 | A1 * | 7/2009 | Park et al. | 313/582 |

* cited by examiner

*Primary Examiner*—Ashok Patel
(74) *Attorney, Agent, or Firm*—Ked & Associates, LLP

(57) ABSTRACT

The present invention relates to a filter and a plasma display device including the filter. The filter is formed on a front surface of a plasma display panel of the plasma display device and includes a first base layer; a second base layer having refractive index smaller than that of the first base layer; and a sheet for protecting external light including a plurality of pattern units formed to be spaced from each other between the first and second base layers, wherein an interval between two pattern units adjacent each other of the plurality of pattern units being larger than a height of the pattern unit.

20 Claims, 15 Drawing Sheets

FILTER AND PLASMA DISPLAY DEVICE THEREOF

BACKGROUND OF THE INVENTION

1. Field of the Invention

The present invention relates to a filter for a display panel, and more particularly, to a filter and a plasma display device thereof in which a sheet for protecting external light is manufactured and disposed at a front surface of a panel in order to shield external light incident upon the panel so that the bright room contrast of the panel is enhanced while maintaining the luminance of the panel.

2. Description of the Conventional Art

Generally, a plasma display panel (PDP) displays images including text and graphic images by applying a predetermined voltage to a plurality of electrodes installed in a discharge space to cause a gas discharge and then exciting phosphors with the aid of plasma generated according to the gas discharge. The PDP is easy to manufacture as large-dimension, light and thin flat displays. In addition, the PDP has advantages in that it can provide wide vertical and horizontal viewing angles, full colors and high luminance.

In the meantime, external light is reflected from a front surface of the PDP due to white phosphors that are exposed on a lower substrate of the PDP when the PDP displays black images. For this reason, the PDP may mistakenly recognize the black images as being brighter than they actually are, thereby causing contrast degradation.

SUMMARY OF THE INVENTION

The present invention proposes to solve the above problems of the prior art. It is an object of the present invention to provide a plasma display device capable of efficiently shielding external light incident upon the PDP so that the bright room contrast and the luminance of the panel are enhanced.

A plasma display device of the present invention includes: a plasma display panel including an upper substrate, a dielectric layer formed on the upper substrate, a lower substrate, and barrier ribs formed on the lower substrate to partition discharge cells; and a filter disposed on a front surface of the panel, the filter including a first base layer; a second base layer with refractive index smaller than that of the first base layer; and a sheet for protecting external light including a plurality of pattern units formed to be spaced from each other between the first and second base layers, wherein an interval between two pattern units adjacent each other of the plurality of pattern units being larger than a height of the pattern unit.

The filter according to the present invention in order to solve the aforementioned technical problems includes a first base layer; a second base layer having refractive index smaller than that of the first base layer; and a sheet for protecting external light including a plurality of pattern units formed to be spaced from each other between the first and second base layers, an interval between two pattern units adjacent each other of the plurality of pattern units being larger than a height of the pattern unit.

DETAILED DESCRIPTION OF THE PREFERRED EMBODIMENT

Figure 1:
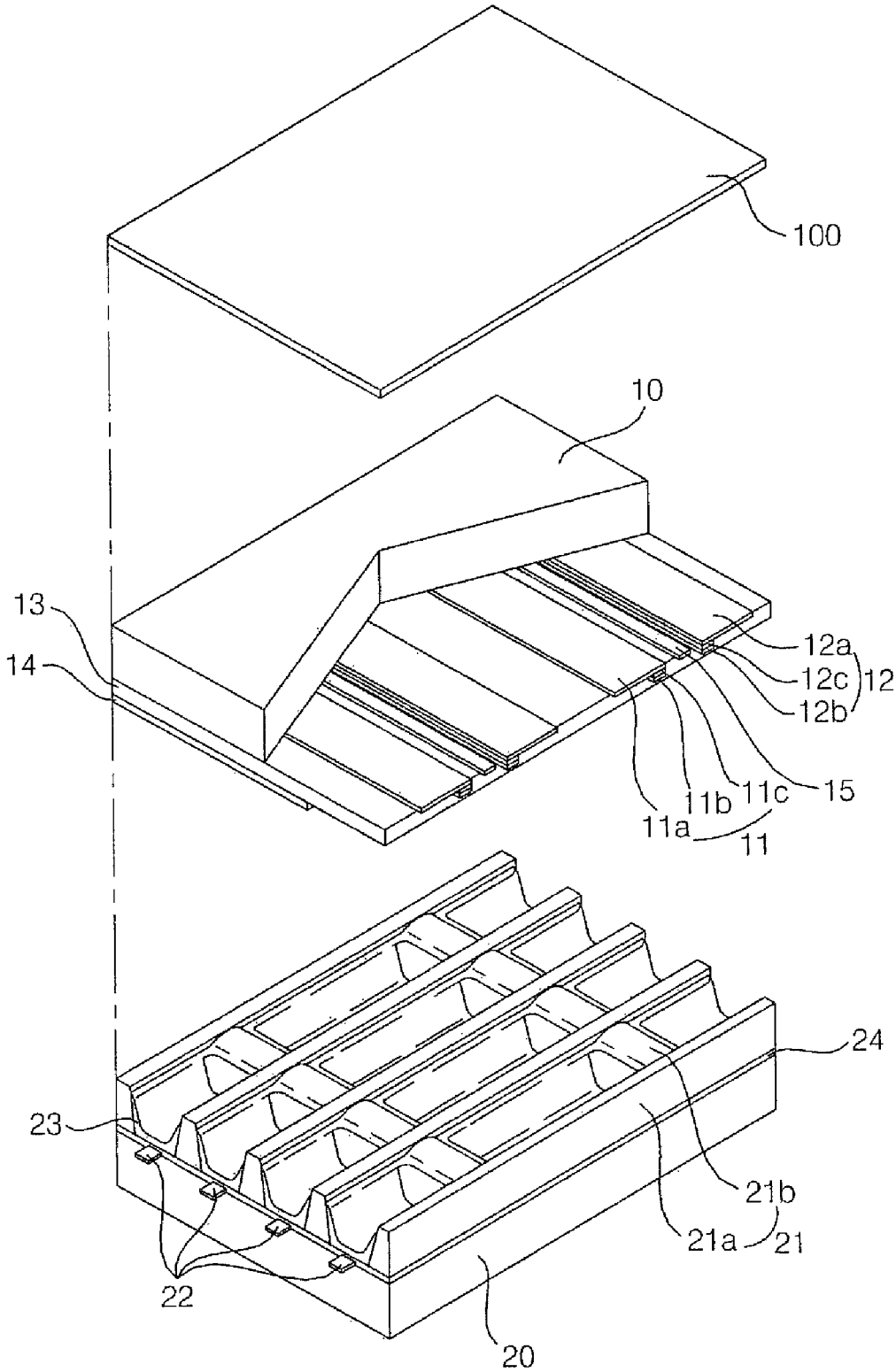
FIG. 1 is a perspective view illustrating a structure of a plasma display panel according to an embodiment of the present invention.

Hereinafter, the present invention will be described in detail with reference to the accompanying FIGS. 1 to 30, in which exemplary embodiments of the invention are shown. FIG. 1 is a perspective view illustrating a plasma display panel (PDP) according to an embodiment of the present invention.

As shown in FIG. 1, a PDP includes a scan electrode 11 and a sustain electrode 12, which are a sustain electrode pair formed on an upper substrate 10, and an address electrode 22 formed on a lower substrate 20.

The sustain electrode pair 11 and 12 include transparent electrodes 11*a* and 12*a* and bus electrodes 11*b* and 12*b* that are generally made of indium-tin-oxide (ITO). The bus electrodes 11*b* and 12*b* can be made of a metal such as silver (Ag) and chrome (Cr) or can be made with a stacked structure of chrome/copper/chrome (Cr/Cu/Cr) or chrome/aluminum/chrome (Cr/Al/Cr). The bus electrodes 11*b* and 12*b* are formed on the transparent electrodes 11*a* and 12*a* to reduce voltage drop due to the transparent electrodes 11*a* and 12*a* having high resistance.

Meanwhile, according to an embodiment of the present invention, the sustain electrode pair 11 and 12 can be composed of a stacked structure of the transparent electrodes 11*a* and 12*a* and the bus electrodes 11*b* and 12*b* or only the bus electrodes 11*b* and 12*b* without the transparent electrodes 11*a* and 12*a*. Because the latter structure does not use the transparent electrodes 11*a* and 12*a*, there is an advantage in that a cost of manufacturing a panel can be decreased. The bus electrodes 11*b* and 12*b* used in the structure can be made of various materials such as a photosensitive material in addition to the above-described materials.

A black matrix (BM), which performs a light protecting function of reducing reflection by absorbing external light that is generated from the outside of the upper substrate 10 and a function of improving purity and contrast of the upper substrate 10, may be disposed between the transparent electrodes 11*a* and 12*a* and the bus electrodes 11*b* and 12*b* of the scan electrode 11 and the sustain electrode 12.

The black matrix according to an embodiment of the present invention is formed on the upper substrate 10 and includes a first black matrix 15 that is formed at a position that is overlapped with a barrier rib 21 and second black matrixes 11*c* and 12*c* that are formed between the transparent electrodes 11*a* and 12*a* and the bus electrodes 11*b* and 12*b*. Here, the first black matrix and the second black matrixes 11*c* and 12*c* that are also referred to as a black layer or a black electrode layer may be physically connected to each other when they are formed at the same time in a forming process or may be not physically connected to each other when they are not formed at the same time.

In addition, when they are physically connected to each other, the first black matrix 15 and the second black matrixes 11*c* and 12*c* are made of the same material, but when they are physically separated from each other, they may be made of different materials.

It is also possible for bus electrodes 11*b* and 12*b* and the barrier rib 21 to perform a light protecting function of reducing reflection by absorbing external light generated from the outside and a function of improving contrast such as the black matrixes, as the bus electrodes 11*b* and 12*b* and the barrier rib 21 are dark colored. Otherwise, it is also possible to perform a function of the black matrix by making the overlapped portion viewed from the front looks like black color, as a specific element, for example a dielectric layer 13, formed in the upper substrate 10, and a specific element, for example the barrier rib 21, formed in the lower substrate 20 are complementarily colored.

An upper dielectric layer 13 and a protective film 14 are stacked in the upper substrate 10 in which the scan electrode 11 and the sustain electrode 12 are formed in parallel. Charged particles, which are generated by a discharge, are accumulated in the upper dielectric layer 13 and perform a function of protecting the sustain electrode pair 11 and 12. The protective film 14 protects the upper dielectric layer 13 from sputtering of charged particles that are generated at a gas discharge and enhances emission efficiency of a secondary electron.

In addition, the address electrode 22 is formed in an intersecting direction of the scan electrode 11 and the sustain electrode 12. Furthermore, a lower dielectric layer 24 and a barrier rib 21 are formed on the lower substrate 20 in which the address electrode 22 is formed.

In addition, a phosphor layer 23 is formed on the surface of the lower dielectric layer 24 and the barrier rib 21. In the barrier rib 21, a vertical barrier rib 21*a* and a horizontal barrier rib 21*b* are formed in a closed manner and the barrier rib 21 physically divides a discharge cell and prevents ultraviolet rays and visible light that are generated by a discharge from leaking to adjacent discharge cells.

Referring to FIG. 1, a filter 100 is preferably formed at the front of the PDP according to the present invention, and the filter 100 may include a sheet for protecting external light, an AR (Anti-Reflection) sheet, an NIR (Near Infrared) shielding sheet and an EMI (ElectroMagnetic Interference) shielding sheet, a diffusion sheet and an optical property sheet.

In case that an interval between the filter 100 and the PDP is 10 μm to 30 μm, it is possible to effectively shield light incident upon the PDP from the outside and to effectively emit light generated from the PDP to the outside. Also, the interval between the filter 100 and the PDP may be 30 μm to 120 μm in order to protect the PDP from the external pressure, etc., and an adhesion layer, which absorbs impact, may be formed between the filter 100 and the PDP.

In an embodiment of the present invention, various shapes of barrier rib 21 structure as well as the barrier rib 21 structure as shown in FIG. 1 can be used. For example, a differential barrier rib structure in which the vertical barrier rib 21*a* and the horizontal barrier rib 21*b* have different heights, a channel type barrier rib structure in which a channel, which can be used as an exhaust passage, is formed in at least one of the vertical barrier rib 21*a* and the horizontal barrier rib 21*b*, and a hollow type barrier rib structure in which a hollow is formed in at least one of the vertical barrier rib 21*a* and the horizontal barrier rib 21*b*, can be used.

In the differential type barrier rib structure, it is more preferable that height of the horizontal barrier rib 21*b* is higher than that of the vertical barrier rib 21*a* and in the channel type barrier rib structure or the hollow type barrier rib structure, it is preferable that a channel or a hollow is formed in the horizontal barrier rib 21*b*.

Meanwhile, in an embodiment of the present invention, it is described as each of R, G, and B discharge cells is disposed on the same line, but they may be disposed in other shapes. For example, delta type of arrangement in which the R, G, and B discharge cells are disposed in a triangle shape may be also used. Furthermore, the discharge cell may have various polygonal shapes such as a quadrilateral shape, a pentagonal shape, and a hexagonal shape.

Furthermore, the phosphor layer 23 emits light by ultraviolet rays that are generated at a gas discharge and generates any one visible light among red color R, green color G, or blue color B light. Here, inert mixed gas such as He+Xe, Ne+Xe, and He+Ne+Xe for performing a discharge is injected into a discharge space that is provided between the upper/lower substrates 10, 20 and the barrier rib 21.

Figure 2:
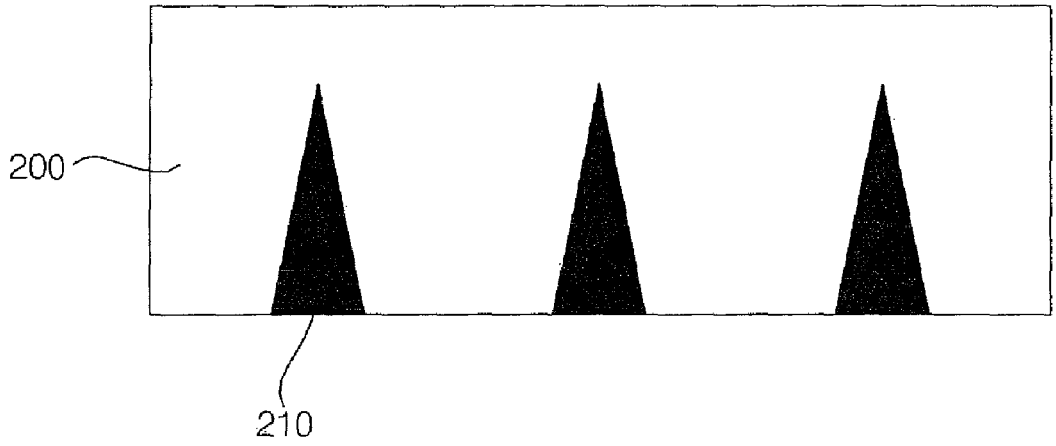
FIG. 2 is a cross-sectional view schematically illustrating a cross-sectional structure of a sheet for protecting external light according to an embodiment of the present invention.

FIG. 2 is a cross-sectional view illustrating a structure of a sheet for protecting external light provided in the filter according to the present invention, and the sheet for protecting external light includes a base unit 200 and pattern units 210.

The base unit 200 is preferably formed of a transparent plastic material, for example a UV-hardened resin-based material, so that light can smoothly transmit therethrough. Alternately, it is possible to use a hard glass material to protect the front of the PDP.

Referring to FIG. 2, the pattern units 210 may be formed as various shapes as well as triangles. The pattern units 210 are formed of a darker material than the base unit 200, preferably, formed of a black material. For example, the pattern units 210 are formed of a black carbon-based material or covered with a black dye in order to maximize the absorption of external light. Hereinafter, a wider one between the upper end and the lower end of the pattern unit 210 is referred to as a lower end of the pattern unit 210.

According to FIG. 2, the lower end of the pattern unit 210 may be disposed at a panel side, and the upper end of the pattern unit 210 may be disposed at a viewer side. Also, the lower end of the pattern unit 210 may also be disposed at the PDP side, and the upper end of the pattern unit 210 may be disposed at the viewer side, contrary to the above arrangement.

In general, an external light source is mostly located over the PDP, and thus, external light is diagonally incident on the PDP from the upper side and is absorbed in the pattern unit 210.

The pattern unit 210 may include a light-absorbing particle, and the light-absorbing particle may be a resin particle colored by a specific color. In order to maximize the light absorbing effect, the light-absorbing particle is preferably colored by a black color.

In order to maximize the absorption of external light and to facilitate the manufacture of the light-absorbing particle and the insertion into the pattern unit 210, the size of the light-absorbing particle may be 1 μm or more. Also, in case that the size of the light-absorbing particle is 1 μm or more, the pattern unit 210 may include the light-absorbing particle of 10% weight or more in order to more effectively absorb external light refracted into the pattern unit 210. That is, the light-absorbing particle of 10% weight or more of the total weight of the pattern unit 210 may be included in the pattern unit 210.

FIGS. 3 to 6 are cross-sectional views illustrating a structure of a sheet for protecting external light according to an embodiment of the present invention in order to explain optical property in accordance with the structure of the sheet for protecting external light.

Figure 3:
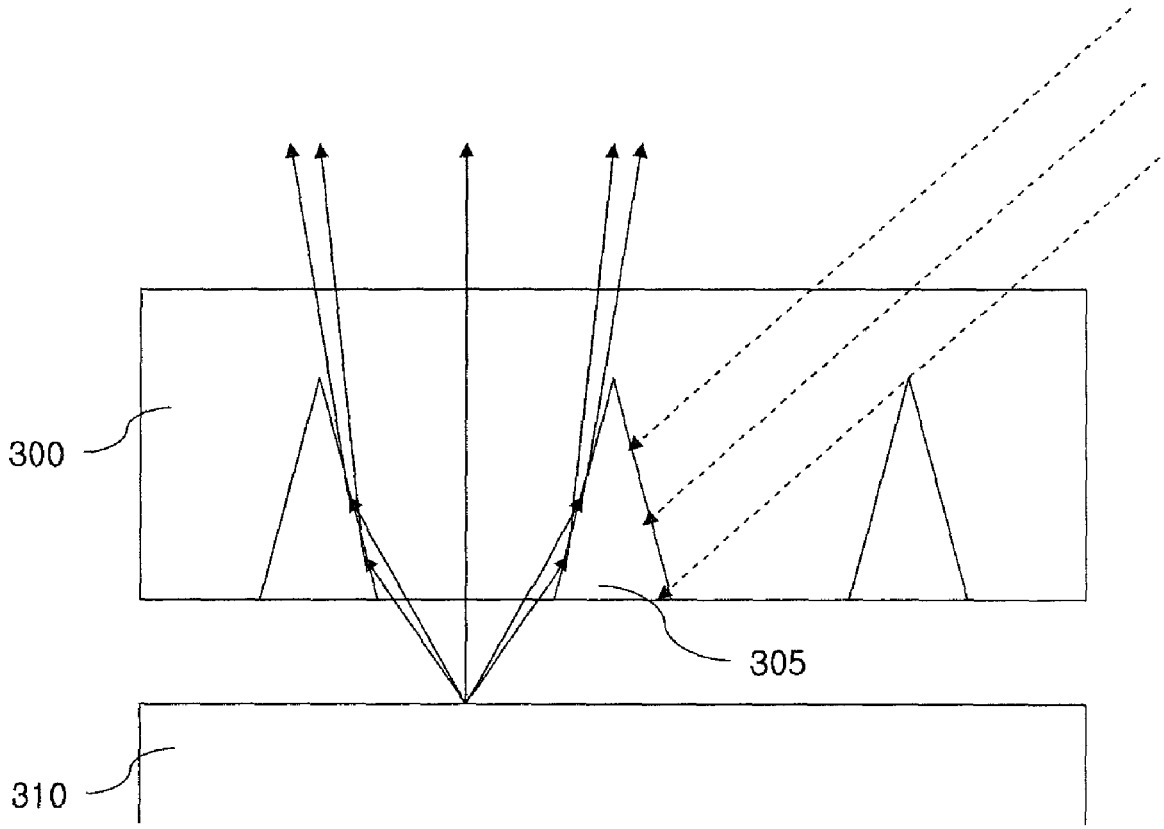
FIGS. 3 to 6 are cross-sectional views illustrating optical property according to a structure of a sheet for protecting external light.

Referring to FIG. 3, a refractive index of the pattern unit 305, particularly, a refractive index of at least the slanted surface of the pattern unit 305 is lower than a refractive index of the base unit 300 in order to enhance the reflectivity of light emitted from the PDP by totally reflecting visible light emitted from the PDP.

As described above, external light which reduces the bright room contrast of the PDP is highly likely to be above the PDP. Referring to FIG. 3, according to Snell's law, external light (illustrated as a dotted line) that is diagonally incident upon the sheet for protecting external light is refracted into and absorbed by the pattern unit 310 which has a lower refractive index than the base unit 300. External light refracted into the pattern unit 305 may be absorbed by the light absorption particle.

Also, light (illustrated as a solid line) that is emitted from the PDP 310 for displaying is totally reflected from the slanted surface of the pattern unit 305 to the outside, i.e., toward the viewer.

As described above, external light (illustrated as a dotted line) is refracted into and absorbed by the pattern unit 305 and light (illustrated as a solid line) emitted from the PDP 310 is totally reflected by the pattern unit 305 because the angle between the external light and the slanted surface of the pattern unit 305 is greater than the angle between the light emitted from the PDP 310 and the slanted surface of the pattern unit 305, as illustrated in FIG. 3.

Therefore, the sheet for protecting external light according to the present invention enhances the bright room contrast of the display image by absorbing the external light to prevent the external light from being reflected toward the viewer and by increasing the reflection of light emitted from the PDP 310.

In order to maximize the absorption of external light and the total reflection of light emitted from the PDP 310 in consideration of the angle of external light incident upon the PDP 310, the refractive index of the pattern unit 305 is preferably 0.3 to 1 times greater than the refractive index of the base unit 300. In order to maximize the total reflection of light emitted from the PDP 310 in consideration of the vertical viewing angle of the PDP, the refractive index of the pattern unit 305 is preferably 0.3 to 0.8 times greater than the refractive index of the base unit 300.

As shown in FIG. 3, when the upper end of the pattern unit 305 is disposed at the viewer side and the refractive index of the pattern unit 305 is lower than the refractive index of the base unit 300, a ghost phenomenon, that is, the phenomenon that an object is not clearly seen by a viewer may be occurred because light emitted from the PDP is reflected on the slanted surface of the pattern unit 305 toward the viewer side.

Figure 4:
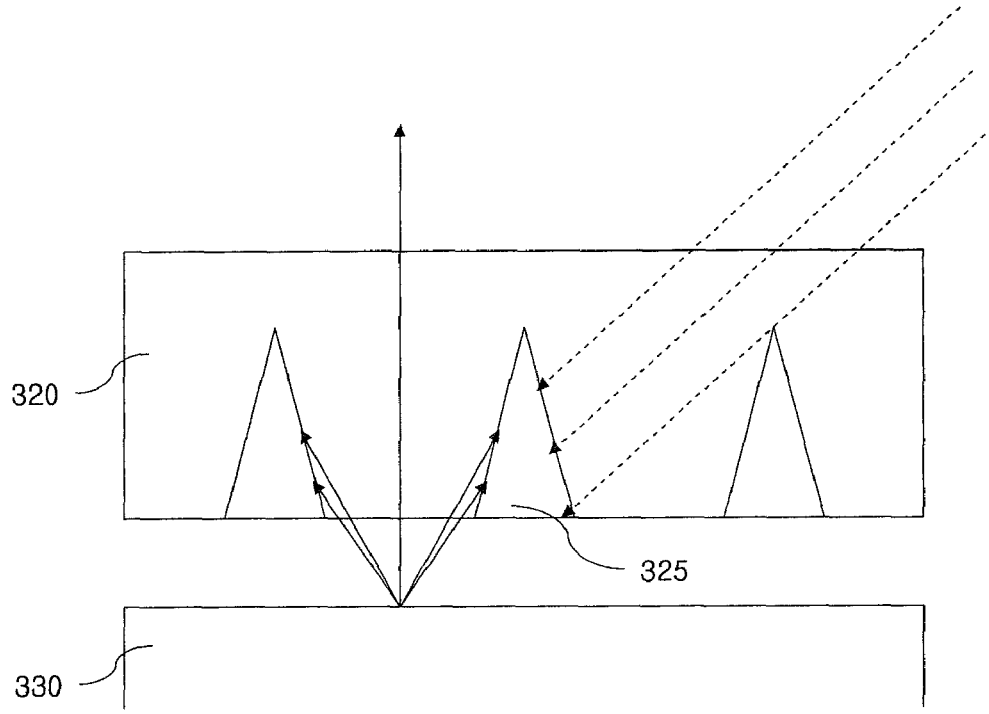

FIG. 4 illustrates the case that the upper end of the pattern unit 325 is disposed at the viewer side and the refractive index of the pattern unit 325 is higher than the refractive index of the base unit 320. Referring to FIG. 4, the refractive index of the pattern unit 320 is greater than the refractive index of the base unit 320, according to Snell's law, external light that is incident upon the pattern unit 325 is totally absorbed by the pattern unit 325.

Therefore, the ghost phenomenon may be reduced when the upper end of the pattern unit 325 is disposed at the viewer side and the refractive index of the pattern unit 325 is higher than the refractive index of the base unit 320. A difference between the refractive index of the pattern unit 325 and the refractive index of the base unit 320 is preferably 0.05 and more in order to prevent the ghost phenomenon by sufficiently absorbing light emitted from the PDP that is diagonally incident upon the pattern unit 325.

When the refractive index of the pattern unit 325 is higher than the refractive index of the base unit 320, light transmittance ratio of the sheet for protecting external light and bright room contrast may be reduced. Therefore, the difference between the refractive index of the pattern unit 325 and the refractive index of the base unit 320 is preferably 0.05 to 0.3 in order to prevent the ghost phenomenon and in order not to considerably reduce light transmittance ratio of the sheet for protecting external light. Also, the refractive index of the pattern unit 325 is preferably 1.0 to 1.3 times greater than the refractive index of the base unit 320 to prevent the ghost phenomenon while maintaining the bright room contrast at a proper level.

Figure 5:
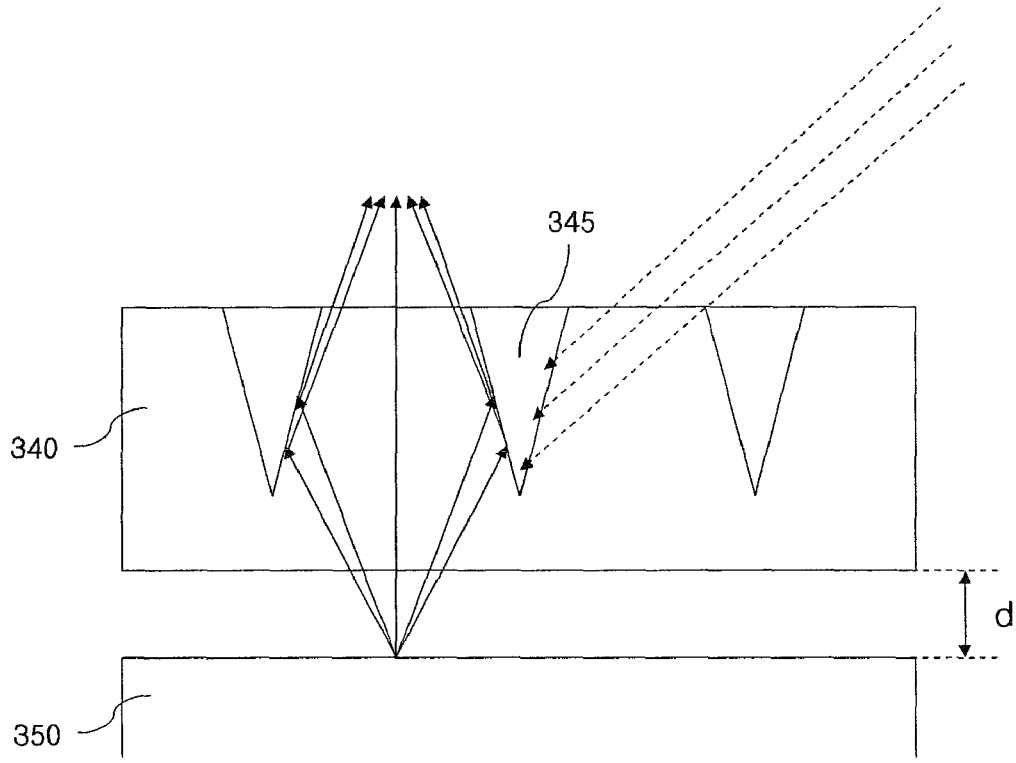

FIG. 5 illustrates the case that the lower end of the pattern unit 345 is disposed at the viewer side and the refractive index of the pattern unit 345 is lower than the refractive index of the base unit 340. As shown in FIG. 5, the external light protecting effect can be enhanced, as external light is allowed to be absorbed in the lower end of the pattern unit 345 by disposing the lower end of the pattern unit 345 at the viewer side on which external light incident. Also, an aperture ratio of the sheet for protecting external light can be enhanced because an interval between the lower ends of the pattern units 345 may be increased than the interval illustrated in FIG. 4.

As shown in FIG. 5, light emitted from the PDP 350 may be reflected at the slanted surface of the pattern unit 345 and be collected around light from the PDP which passes through the base unit 340. Therefore, the ghost phenomenon may be reduced without considerably lowering the light transmittance ratio of the sheet for protecting external light.

An interval d between the PDP 350 and the sheet for protecting external light is preferably 1.5 to 3.5 mm in order to prevent the ghost phenomenon as light from the PDP is reflected from the slanted surface of the pattern unit 345 and is collected around light from the PDP which passes through the base unit 340.

Figure 6:
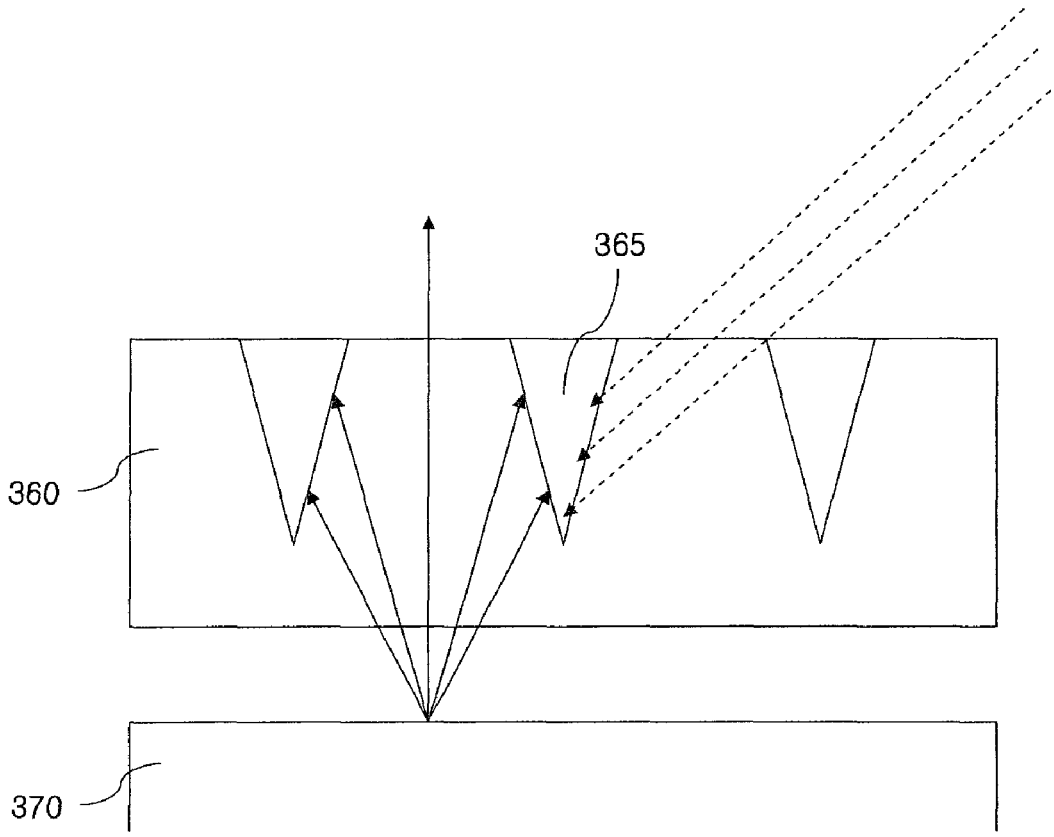

FIG. 6 illustrates the case that the lower end of the pattern unit 365 is disposed at the viewer side and the refractive index of the pattern unit 365 is higher than the refractive index of the base unit 360. As shown in FIG. 6, light from the PDP which is incident upon the slanted surface of the pattern unit 365 may be absorbed in the pattern units 365 because the refractive index of the pattern unit 365 is higher than the refractive index of the base unit 360. Therefore, the ghost phenomenon can be reduced, since images are displayed by light from the PDP which passes through the base unit 360.

In addition, the external light absorbing effect can be enhanced, since the refractive index of the pattern unit 365 is higher than the refractive index of the base unit 360.

Figure 7:
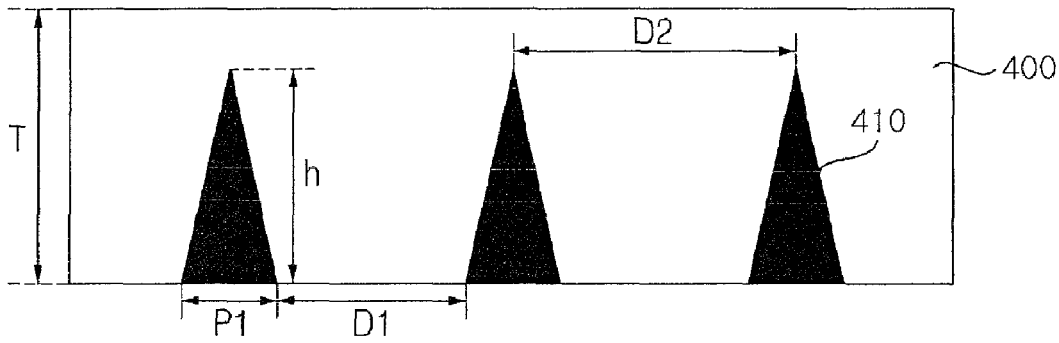
FIG. 7 is a cross-sectional view illustrating a shape of the pattern units of the sheet for protecting external light according to a first embodiment of the present invention.

FIG. 7 is a cross-sectional view illustrating a structure of a sheet for protecting external light provided in a filter according to the present invention. When a thickness T of the sheet for protecting external light is 20 μm to 250 μm, the manufacture of the sheet for protecting external light can be facilitated and the appropriate light transmittance ratio of the sheet for protecting external light can be obtained. The thickness T may be set to 100 μm to 180 μm in order to smoothly transmit light emitted form the PDP, to effectively absorb and protect external light refracted into the pattern unit 410 and to enhance the durability of the sheet for protecting external light.

Referring to FIG. 7, the pattern unit 410 formed on the base unit 400 may be formed as a triangle, and more preferably, as equilateral triangles. Also, the lower end width P1 of the pattern unit 410 may be 18 μm to 35 μm, and in this case, it is possible to ensure an optimum aperture ratio and maximize external light protecting efficiency so that light emitted from the PDP can be smoothly discharged toward an user side.

The height h of the pattern unit 410 is set to 80 μm to 170 μm, and thus, it is possible to make a gradient of the slanted surface capable of effectively absorbing external light and reflecting light emitted from the PDP. Also, it is possible to prevent the pattern unit 410 from being short-circuited.

In order to assure a sufficient aperture ratio to display images with optimum luminance through discharge of light emitted from the PDP toward the user side and to provide an optimum gradient of the slanted surface of the pattern unit 410 for enhancing the external light protecting efficiency and the reflection efficiency, an interval D1 between the pattern units adjacent each other may be set to 40 μm to 90 μm, and an interval D2 between the upper ends of the pattern units adjacent each other may be set to 90 μm to 130 μm.

Due to the above-described reasons, an optimum aperture ratio for displaying images can be obtained when the interval D1 is 1.1 to 5 times greater than the lower end width P1 of the pattern unit 410. Also, in order to obtain an optimum aperture ratio and to optimize the external light protecting efficiency and the reflection efficiency, the interval D1 between the lower ends of the pattern units 410 adjacent each other may be set to 1.5 to 3.5 times greater than the lower end width of the pattern unit 410.

When the height h of the pattern unit 410 is 0.89 to 4.25 times greater than the interval D1 between the pattern units adjacent each other, external light diagonally incident upon the sheet for protecting external light from above can be prevented from being incident upon the PDP. Also, in order to prevent the pattern unit 410 from being short-circuited and to optimize the reflection efficiency of light emitted from the PDP, the height h of the pattern unit 410 may be set to 1.5 to 3 times greater than the interval D1 between the pattern units adjacent each other.

In addition, when the interval D2 between the upper ends of the pattern units adjacent each other is 1 to 3.25 times greater than the interval D1 between lower ends of the pattern units adjacent each other, a sufficient aperture ratio for displaying images with optimum luminance can be obtained. Also, in order to maximize the total reflection efficiency of light emitted from the PDP by the slanted surface of the pattern unit 410, the interval D2 between the upper ends of the pattern units adjacent each other may be set to 1.2 to 2.5 times greater than the interval D1 between lower ends of the pattern units adjacent each other.

Although a structure of the sheet for protecting external light according to the present invention has been explained with the case where the upper end of the pattern unit 410 is disposed at a viewer side, it is also applicable to the case where the lower end of the pattern unit 410 is disposed at a viewer side with reference to FIG. 7.

Figure 8:
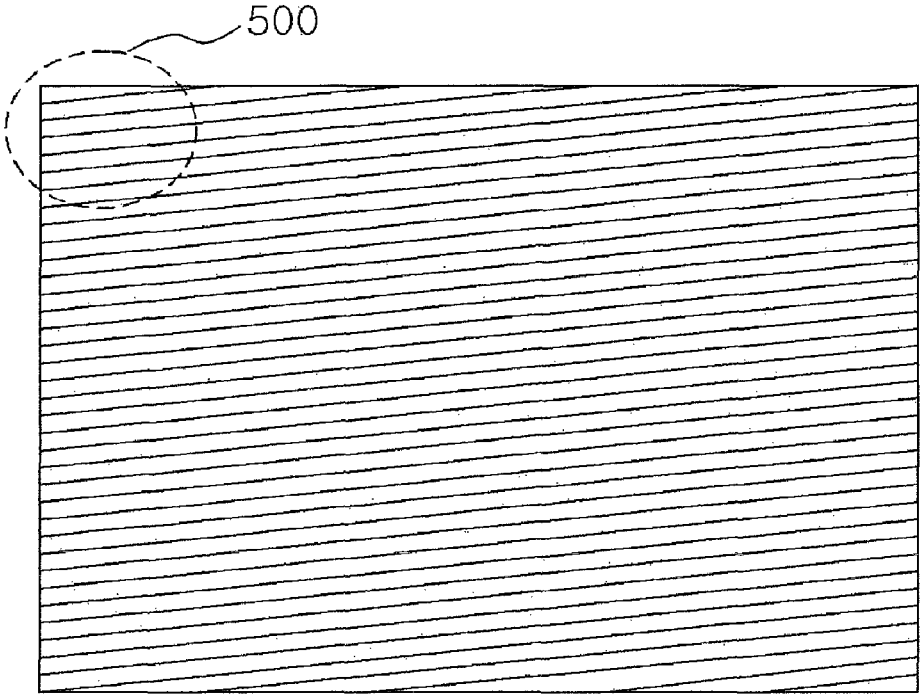
FIGS. 8 and 9 are views showing one embodiment of front shapes of pattern units formed in a row on a sheet for protecting external light.
Figure 9:
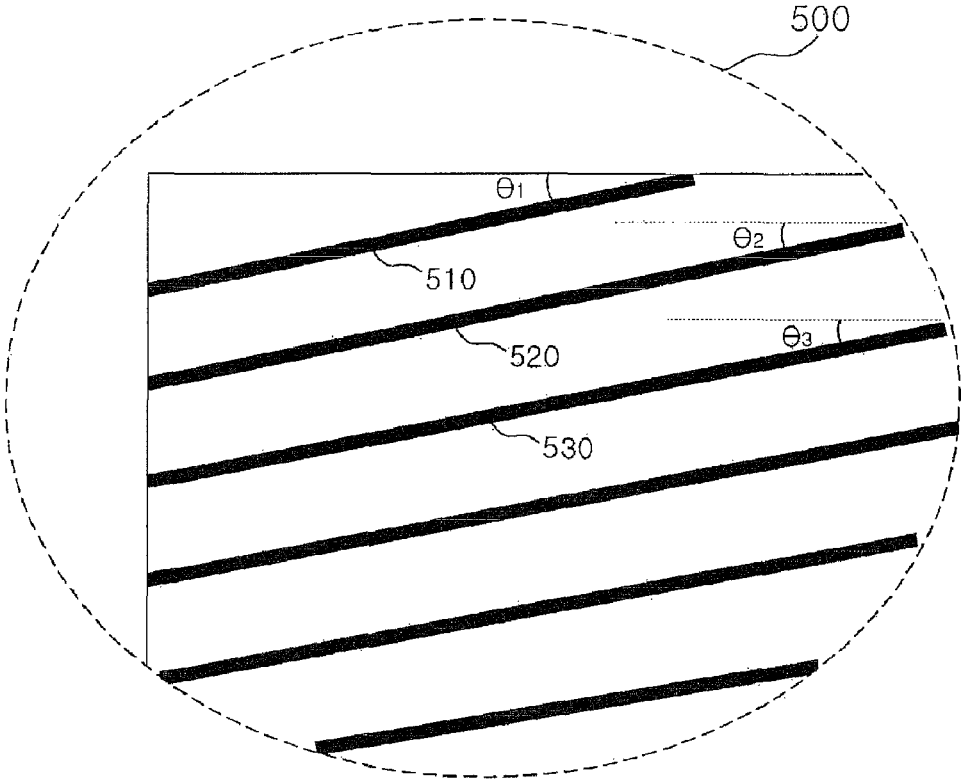

FIGS. 8 and 9 are views showing one embodiment of front shapes of pattern units formed in a row on a sheet for protecting external light. Preferably, the pattern units as shown are formed in a row and at predetermined interval on the base unit.

The plurality of pattern units formed at the predetermined interval on the sheet for protecting external light and the parts such as the black matrix, the black layer, the bus electrode, the barrier rib, etc., which have the predetermined pattern, formed on the panel are overlapped so that a moiré phenomenon may occur. The moiré phenomenon means a low frequency pattern generated by the overlap of patterns in a similar lattice shape. As an example, there is a moiré pattern, or the like, viewed when mosquito nets are placed to be overlapped.

As shown in FIGS. 8 and 9, the moiré phenomenon, which is generated by the overlap of the plurality of pattern units and the black matrix, the black layer, the bus electrode, the barrier rib, etc., due to an inclined formation thereof, can be reduced.

Figure 10:
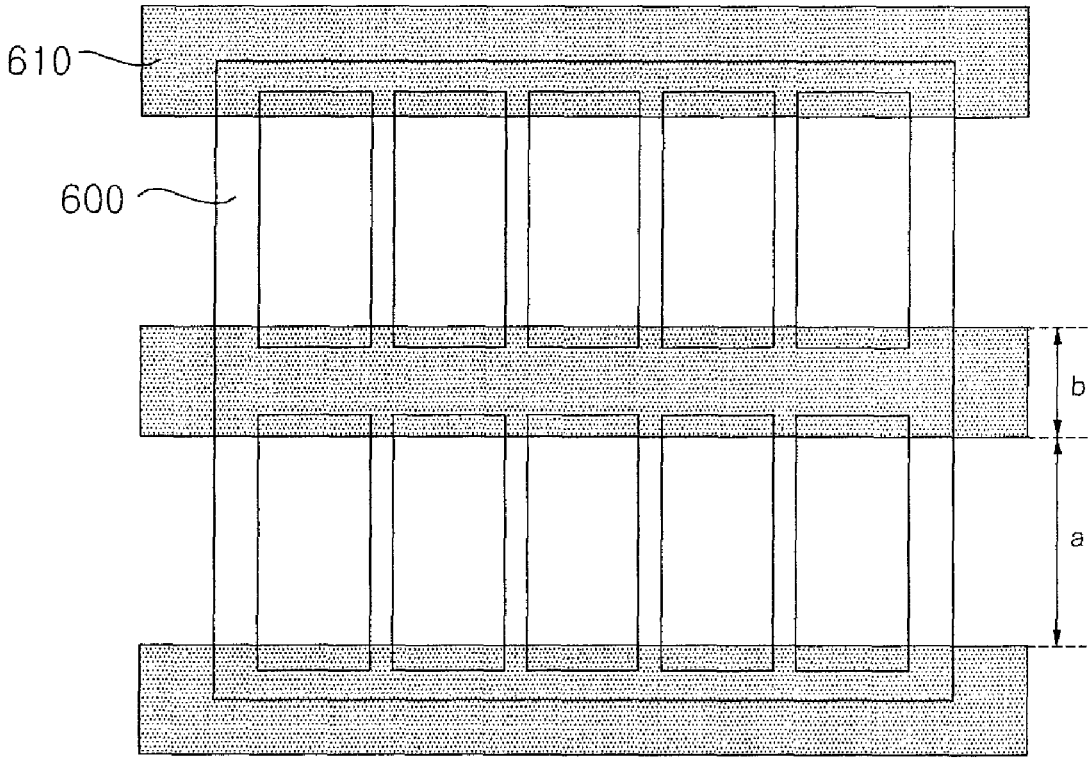
FIG. 10 is a view schematically showing an embodiment of a structure of a black matrix formed on an upper substrate of a panel.

As shown in FIG. 10, since the black matrix 610 is formed on the upper substrate of the panel in a direction parallel with a horizontal barrier rib formed on the lower substrate of the panel, the black matrix is parallel with the upper end or lower end of the sheet for protecting external light shown in FIGS. 8 and 9. In FIG. 9, an angle ($\Theta_1$, $\Theta_2$, $\Theta_3$) of the pattern units and the upper end of the sheet for protecting external light indicates an angle of the pattern unit and the black matrix formed on the panel.

When the angle between the pattern unit of the sheet for protecting external light and the black matrix formed on the panel has 0.5 to 20° and the pattern unit is obliquely formed, the moiré phenomenon may be reduced. Also, considering many cases where the external light incident on the panel exists on an upper end of a user's head, when the angle between the pattern unit and the black matrix is 0.5 to 5°, the moiré phenomenon is prevented and the optimum aperture ration is assured so that the reflection efficiency of panel light can be increased and the external light can efficiently be blocked.

FIG. 9 is an enlarged view of a portion of the sheet for protecting external light shown in FIG. 8. Preferably, pattern units 510, 520, 530, 540, 550, and 560 formed in a row are formed to be parallel to each other. Even when they are not formed to be parallel to each other, the angle between the pattern units 510, 520, 530, 540, 550, and 560 and the black matrix preferably have the range described above.

Also, for the aforementioned reasons, the angle ($\Theta_1$, $\Theta_2$, $\Theta_3$) between the pattern unit of the sheet for protecting external light and the bus electrode formed on the upper substrate of the panel or the horizontal barrier rib formed on the lower substrate thereof is 0.5 to 20°, the moiré phenomenon can be reduced. Also, considering many cases where the external light incident on the panel exists on the upper end of the user's head, when the angle ($\Theta_1$, $\Theta_2$, $\Theta_3$) between the pattern unit and the bus electrode or the horizontal barrier rib is 0.5 to 5°, the moiré phenomenon is prevented and the optimum aperture ration is assured so that the reflection efficiency of panel light can be increased and the external light can efficiently be blocked.

In FIGS. 8 and 9, the pattern unit is obliquely formed in a direction from a right lower end to a left upper end of the sheet for protecting external light, however, in other embodiments, the pattern unit may obliquely be formed in a direction from a left upper end to a right lower end, having the angles as described above.

FIG. 10 is a view schematically showing one embodiment of a structure of a black matrix formed on a panel.

Referring to FIG. 10, the black matrix 610 may be formed to be overlapped with the horizontal barrier rib formed on the lower substrate 600. Also, as shown in FIG. 10 the black matrix 610 is formed to be overlapped with the scan electrode and the sustain electrode formed on the upper substrate so that the scan electrode and the sustain electrode may be covered by means of the black matrix 610.

In this case, when a width (b) of the black matrix 610 is 200 μm to 400 μm and an interval (a) between the black matrixes adjacent each other is 300 μm to 600 μm, the aperture ratio of the panel is assured so that the display image has the optimum luminance, and the light protecting efficiency reducing the reflection by absorbing the external light generated from the external and the efficiency improving the purity and contrast of the upper substrate can be maximized.

As in the case shown in FIG. 10, in the case where the black matrix 610 is formed to be overlapped with the scan electrode and the sustain electrode, when the width (b) of the black matrix 610 is 10 to 15 times greater than a width P1 of the pattern unit of the sheet for protecting external light, the moiré phenomenon is prevented and the optimum aperture ratio of the panel can be assured and the efficiency protecting external light can be maximized, and when the interval (a) between the black matrixes adjacent each other is 4 to 9 times greater than the interval between the pattern units adjacent each other, the reflection efficiency of the panel light can be optimized and the moiré phenomenon can be reduced.

FIGS. 11 to 15 are cross-sectional views showing embodiments of a structure of a sheet for protecting external light according to the present invention, wherein a layer for reflecting external light incident from the external is disposed to be adjacent to a panel.

Figure 11:
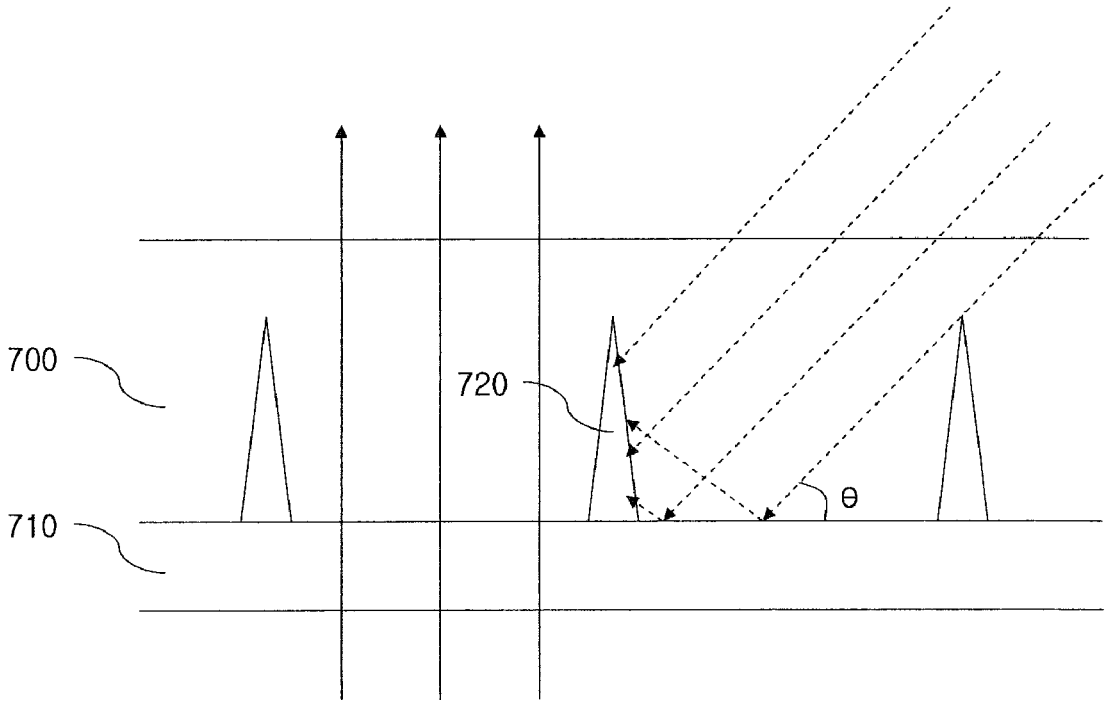
FIGS. 11 to 14 are cross-sectional views showing embodiments of a structure of a sheet for protecting external light where a layer for reflecting external light is disposed to be adjacent to a panel.

Referring to FIG. 11, the sheet for protecting external light according to the sheet for protecting external light according to one embodiment of the present invention may include a first base layer 700, a second base layer 710 with refractive index smaller than that of the first base layer 700, and a pattern unit 720 formed between the first and second base layers 700 and 710.

The first base layer 700 and the pattern unit 720 may have the same structure or shape as the base unit and the pattern unit described with reference to FIGS. 2 to 10.

As shown in FIG. 11, since the second base layer 710 has smaller refractive index than that of the first base layer 700, the incident external light (indicated by a dashed line) may be reflected from the second base layer 710 and the external light reflected from the second base layer 710 may be absorbed into means of the pattern unit 720.

As described above, since the external light penetrating through the first base layer 700 is reflected from the second base layer 710 and is thus absorbed into the pattern unit, all the external light may be absorbed into the pattern unit 720 even when the interval between the pattern units adjacent each other is further increased as compared to the structure of the sheet for protecting external light.

Also, the aperture ratio of the sheet for protecting external light is improved by increasing the interval between the pattern units adjacent each other so that the luminance of the display image can be improved according to the increase in the amount of panel light (indicated by a solid line) emitted from the panel.

In order to totally reflect the external light from the second base layer 710, the second base layer 710 may have very small refractive index of 1.0 to 1.2. Also, the external light having an incident angle in the range of about 35 to 60° is reflected and in order to prevent the panel light from being back reflected from the upper end of the first base layer 700 to the internal, the refractive index of the first base layer 700 may have 1.2 to 2.0 times greater than the refractive index of the second base layer 710.

The second base layer 710 may be an air layer having refractive index approaching to 1. At this time, a difference in the refractive index of the first base layer 700 and the second base layer 710 may be 0.2 to 1.0 for the aforementioned reasons.

Also, it is preferable that the refractive index of the pattern unit 720 is equal to or larger than the refractive index of the first base layer 700 so that the external light from the second base layer 710 is not back reflected but is absorbed. As above, when the refractive index of the pattern unit 720 is 0.05 to 0.3 times greater than that of the first base layer 700, the ghost phenomenon can be prevented without significantly degrading the transmittance of the sheet for protecting external light.

Figure 12:
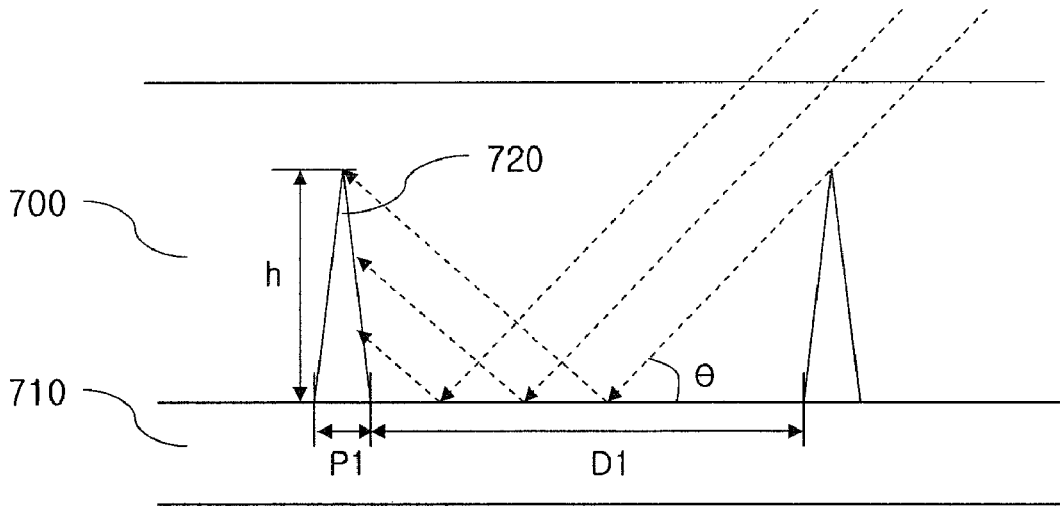

Referring to FIG. 12, assuming that the incident angle (θ) of the external light is about 45°, it is preferable that the interval between the pattern units adjacent each other is 2 times less than the height of the pattern unit (h) so that all the external light reflected from the second base layer 710 is absorbed into the pattern unit 720. Therefore, in order to improve the luminance and the external light absorbing efficiency by increasing the aperture ratio of the sheet for protecting external light, the interval D1 between the pattern units adjacent each other may be 1.1 to 2 times greater than the height (h) of the pattern unit.

Accordingly, when the height (h) of the pattern unit is 80 μm to 170 μm to effectively absorb the external light and reflect the panel light as described above, the interval D1 between the pattern units adjacent each other may be 88 μm to 340 μm.

Therefore, when the lower end width P1 of the pattern unit 720 is formed in 18 μm to 35 μm in order to assure the aperture ratio for smoothly emitting the panel light and maximize the external light protecting efficiency, the interval D1 between the pattern units adjacent each other may be 2.5 to 18.9 times greater than the lower end width P1 of the pattern units 720.

Figure 13:
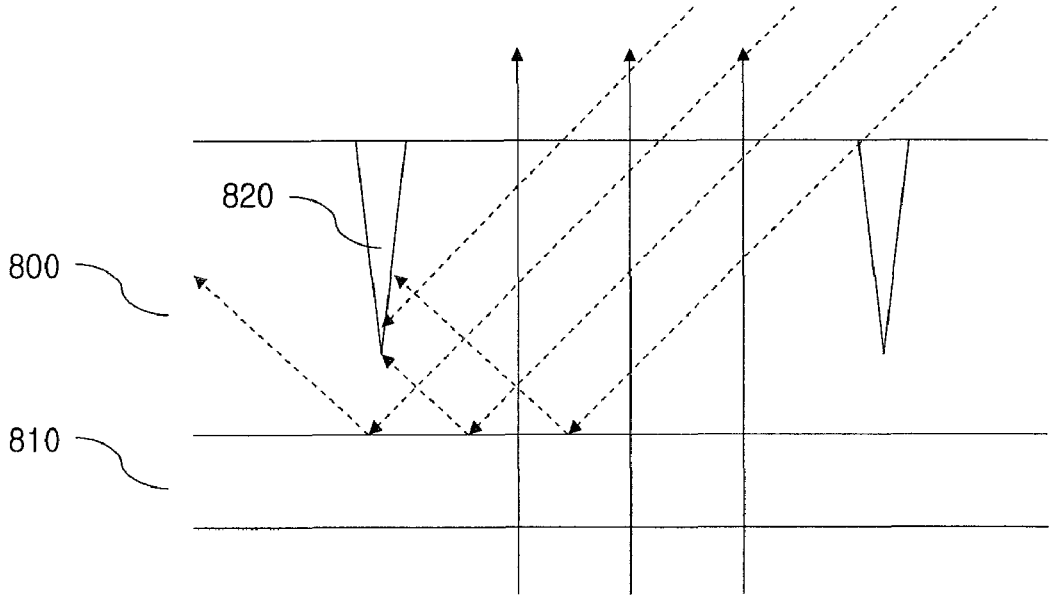

Referring to FIG. 13, the sheet for protecting external light may include a first base layer 800, a second base layer 810 having refractive index smaller than that of the first base layer 800, and a pattern unit 820 whose lower end with a large width is disposed on a user side and upper end with a small width is disposed on a panel side. At this time, the external light, which is reflected from the second base layer 810 and is not absorbed, may absorbed into other pattern units adjacent the pattern unit 820.

Figure 14:
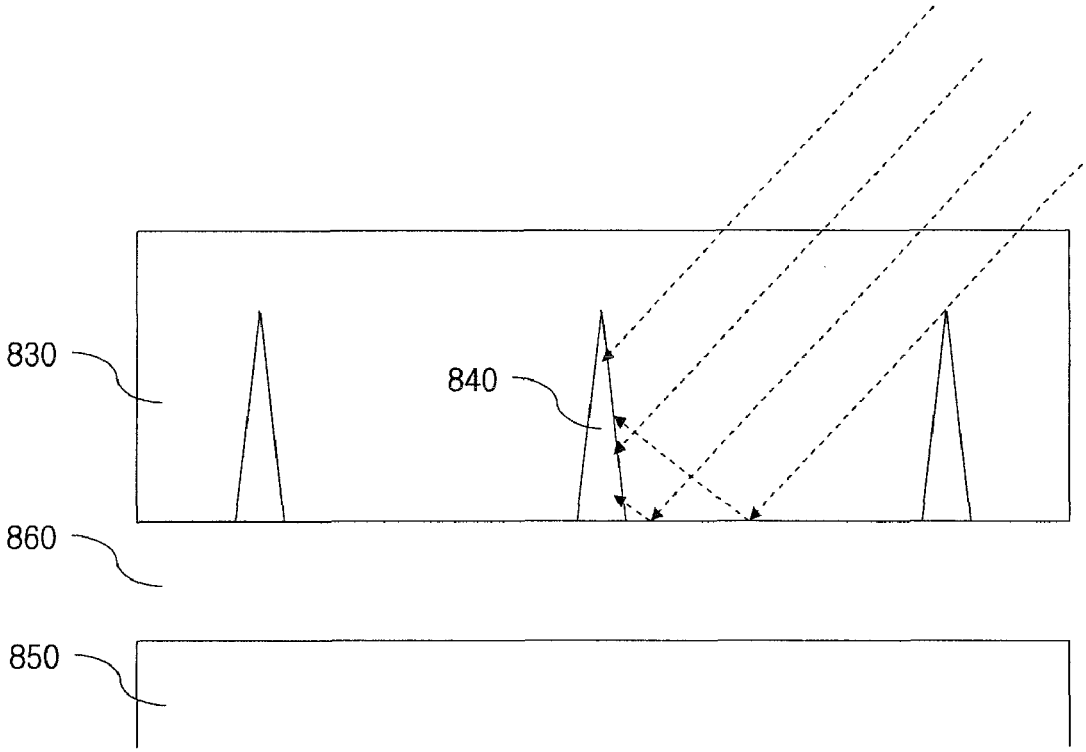

Referring to FIG. 14, the sheet for protecting external light includes a base unit 830 and a pattern unit 840. An air layer 860 may be positioned between a panel 850 and the sheet for protecting external light. Since the air layer 860 has very small refractive index approaching 1, the air layer 860 between the panel 850 and the sheet for protecting external light may be the second base layers 710 and 810 described with reference to FIGS. 11 to 13.

In other words, since the base unit 830 has refractive index larger than that of the air layer 860, for example, refractive index of 1.2 to 2.0, the external light penetrating through the base unit 830 may be reflected from the air layer 860 and then absorbed into the pattern unit 840.

FIGS. 15 to 19 are cross-sectional views illustrating the shape of the pattern units of the sheet for protecting external light according to other embodiments of the present invention.

Figure 15:
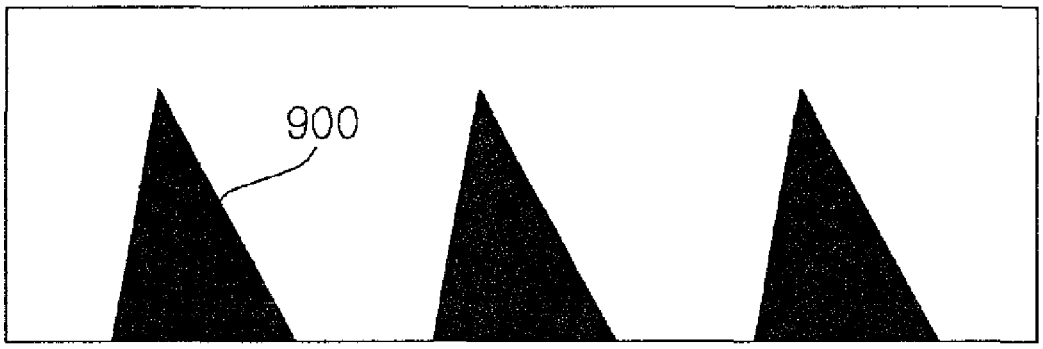
FIGS. 15 to 19 are cross-sectional views illustrating a shape of the pattern units of the sheet for protecting external light according to second to seventh embodiments of the present invention.

Referring to FIG. 15, the pattern units 900 may be horizontally asymmetrical. That is, left and right slanted surfaces of the pattern units 900 may have different areas or may form different angles with the lower end. In general, an external light source is located above the PDP, and thus, external light is highly likely to be incident upon the PDP from above within a predetermined angle range. Therefore, in order to enhance the absorption of external light and the reflection rate of light emitted from the PDP, upper slanted surface of two slanted surfaces of the pattern units 900 may be gentler than lower slanted surface. That is, the upper slanted surface of two slanted surfaces of the pattern units 900 may be less steep than lower slanted surface.

Figure 16:
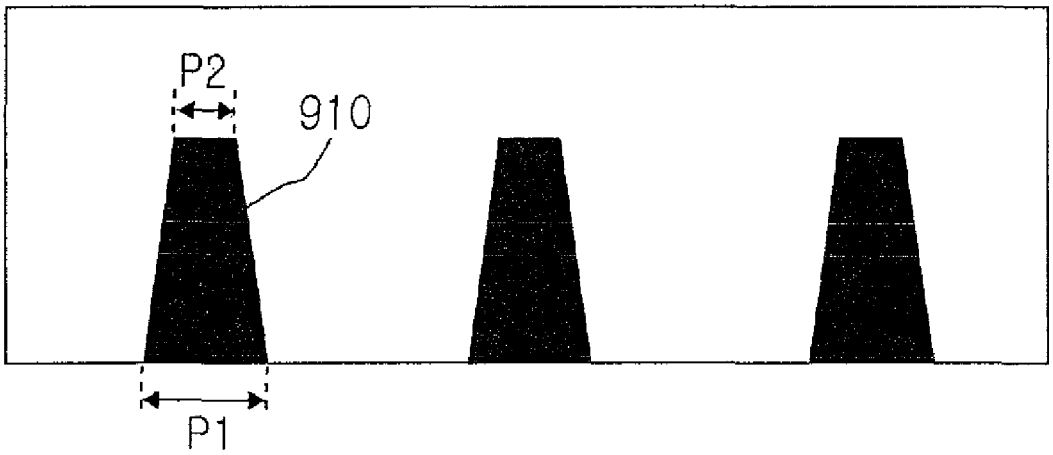

Referring to FIG. 16, the pattern units 910 may be trapezoidal, and in this case, a upper end width P2 of the pattern units is less than a lower end width P1 of the pattern units. Also, the upper end width P2 of the pattern units 910 may be 10 μm or less, and therefore the slope of the slanted surfaces can be determined according to the relationship between the lower end width P1 so that the absorption of external light and the reflection of light emitted from the PDP can be optimized.

Figure 17:
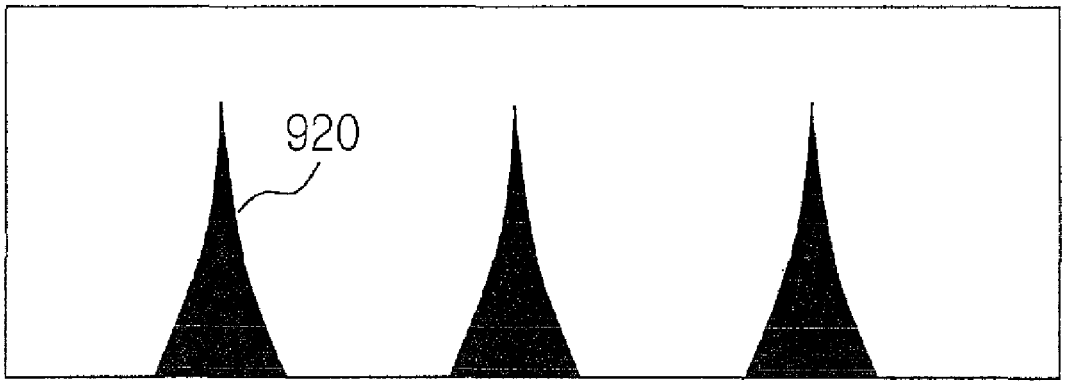
Figure 19:
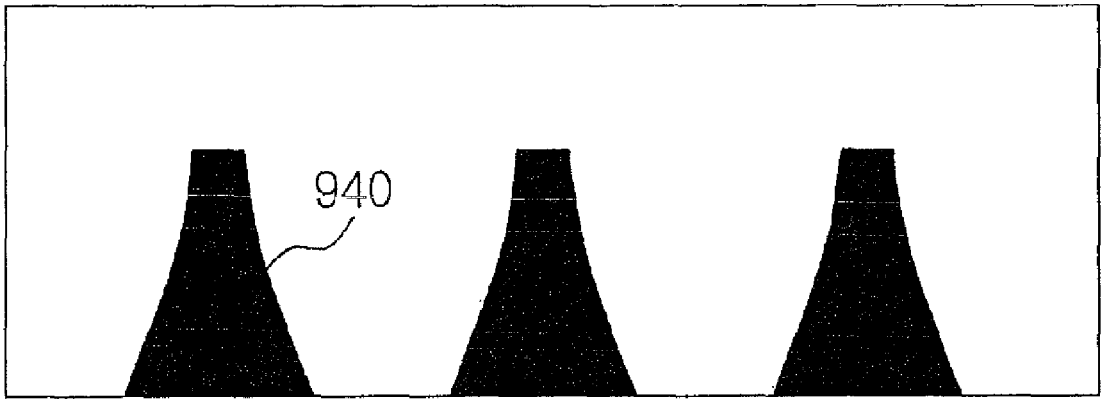

As shown in FIGS. 17 and 19, the pattern units 920, 930 and 940 of the sheet for protecting external light may have a curved profile having a predetermined curvature at the left and right slanted surfaces. In this case, the slope angle of the slanted surface of the pattern units 920, 930 and 940 is preferably getting gentle in a direction to the upper end from the lower end.

Figure 18:
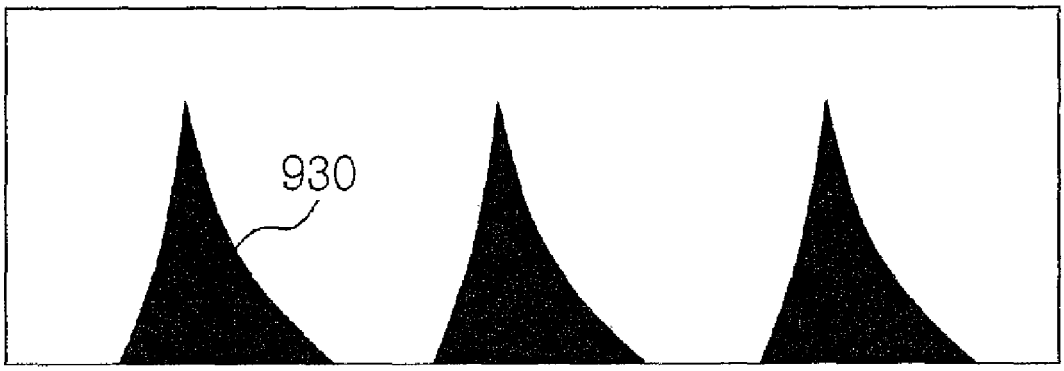

Also, according to the embodiments in respect to the shape of the pattern units shown in FIGS. 17 to 19, edge portion of the pattern units may have a curved profile having a predetermined curvature.

Figure 20:
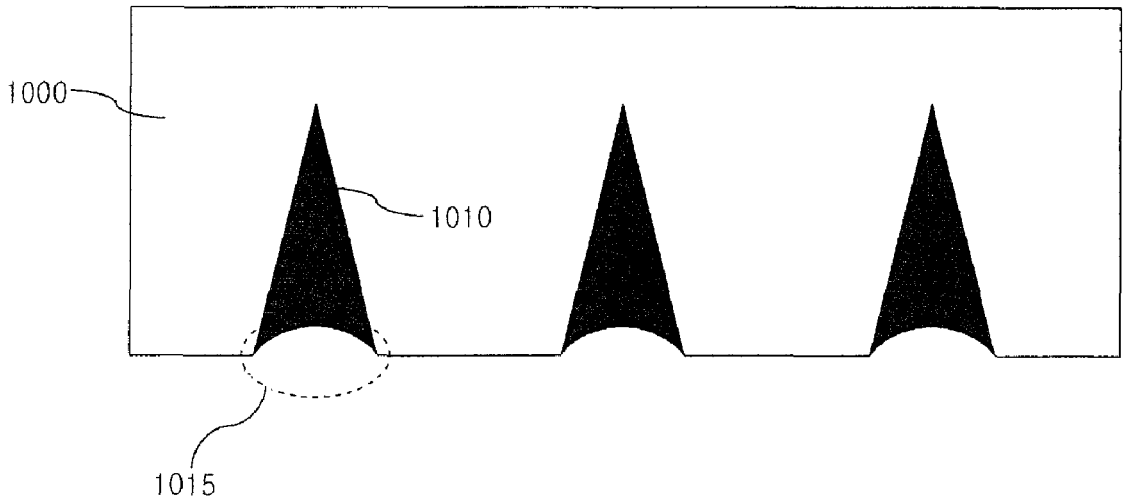
FIGS. 20 to 25 are cross-sectional views illustrating a cross-sectional shape of the pattern units of concave profile at the lower end of the pattern units according to embodiments of the present invention and explaining the optical property thereof.

FIG. 20 is a cross-sectional view illustrating the shape of the pattern units of concave profile at the lower end according to embodiments of the present invention.

As shown in FIG. 20, bleeding phenomenon of the image that is generated as light emitted from the PDP is reflected on the lower end 1015 of the pattern units can be reduced by forming a center of the lower end 1015 of the pattern units as a round hole or a concave. Also, when the sheet for protecting external light is attached to another functional sheet or the PDP, adhesive force can be enhanced as the area of the contact portion is increased.

That is, the pattern units 1010 having a concave lower end 1015 may be formed by forming the pattern units 1010 in which the height of the center area is lower than the height of the outer most contour.

The pattern units 1010 may be formed by filling light-absorbing materials into a groove formed in the base unit 1000, wherein some of the grooves formed in the base unit 1000 may be filled by the light-absorbing materials and the rest of the grooves may be left as an occupied space. Therefore, the lower end 1015 of the pattern units 1010 may be a concave shape in which the center area is depressed into the inside.

Figure 21:
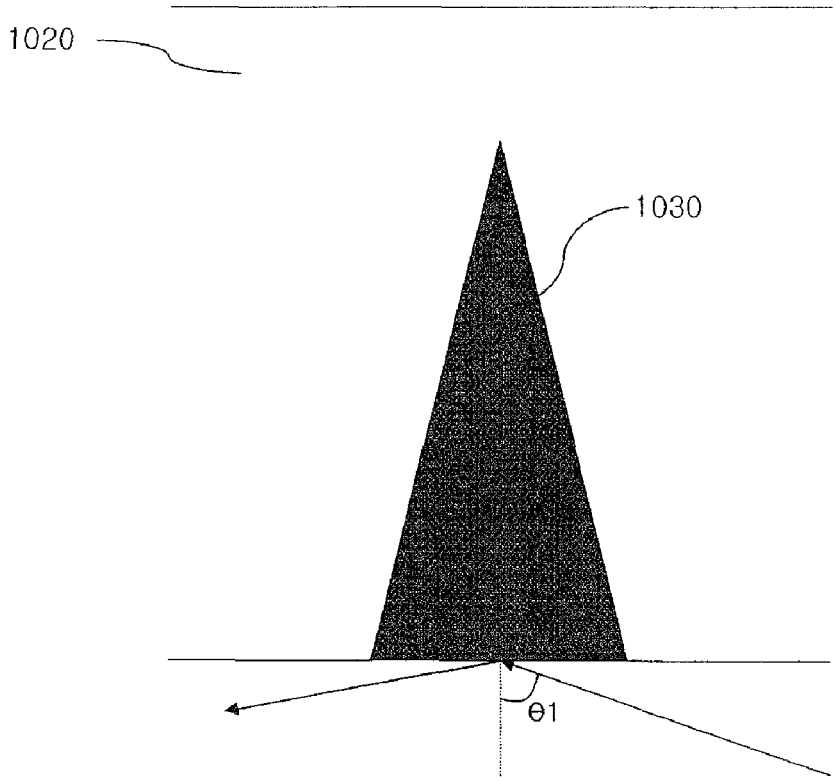
Figure 22:
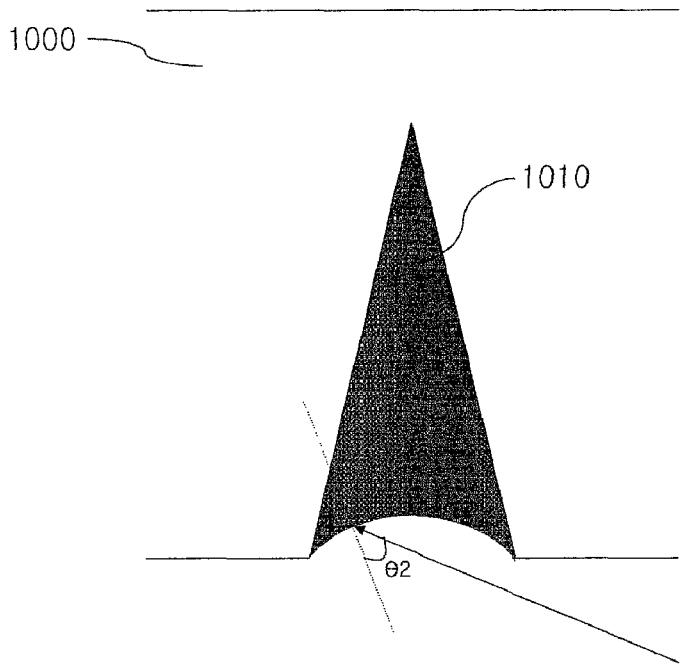

As shown in FIG. 21, light that is emitted from the PDP and diagonally incident upon the lower end of the pattern units 1030 may be reflected toward the PDP, when the lower end of the pattern units 1030 is flat. As images, to be displayed at a specific position by light reflected toward the PDP, are displayed around the specific position, and thus, the sharpness of the display images may be reduced because the bleeding phenomenon occurs.

Referring to FIG. 21, the incident angle θ2 that is diagonally incident upon the lower end of the pattern units 1010 having a depressed shape is smaller than the incident angle θ1 that is incident upon the lower end of the pattern units 1030 having a flat shape shown in FIG. 21. Therefore, the PDP light that is reflected on the lower end of the pattern units 1030 having a flat shape shown in FIG. 21 may be absorbed into the pattern units 1010 at the lower end of the pattern units 1010 having a depressed shape shown in FIG. 22. Therefore, the sharpness of the display images may be enhanced by reducing the bleeding phenomenon of the display images.

Figure 23:
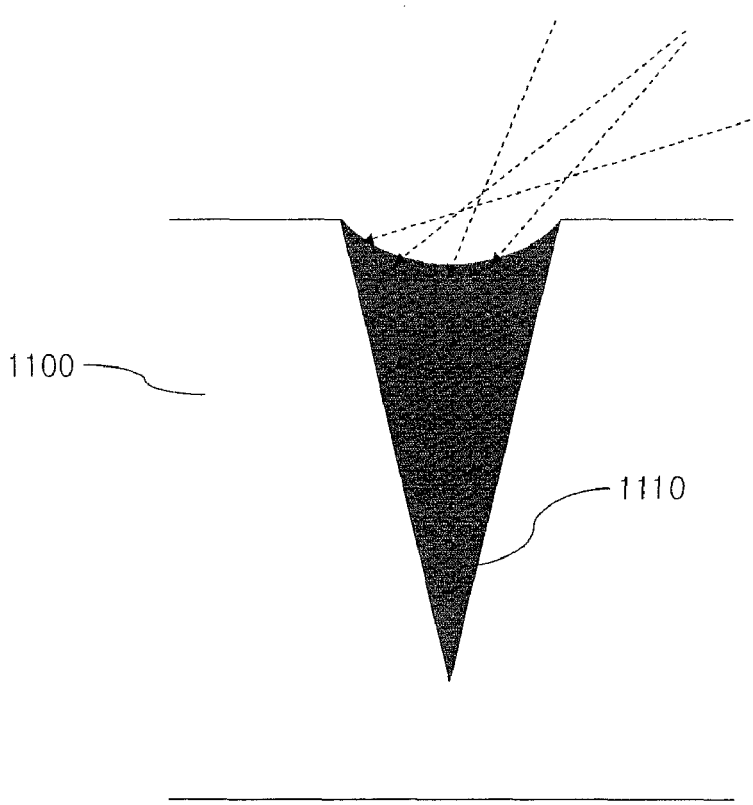

FIG. 23 is a cross-sectional view illustrating a structure of the sheet for protecting external light with the pattern units 1110 having a concave shape at the lower end, which is disposed at a viewer side.

Referring to FIG. 23, incident angle range of external light that is absorbed in the lower end of the pattern units 1110 can be increased by forming the lower end of the pattern units 1110 as a concave. That is, when the lower end of the pattern units 1110 is formed as a concave, the incident angle of external light that is incident upon the lower end of the pattern units 1110 may be increased, and thus, the absorption of external light can be increased.

Figure 24:
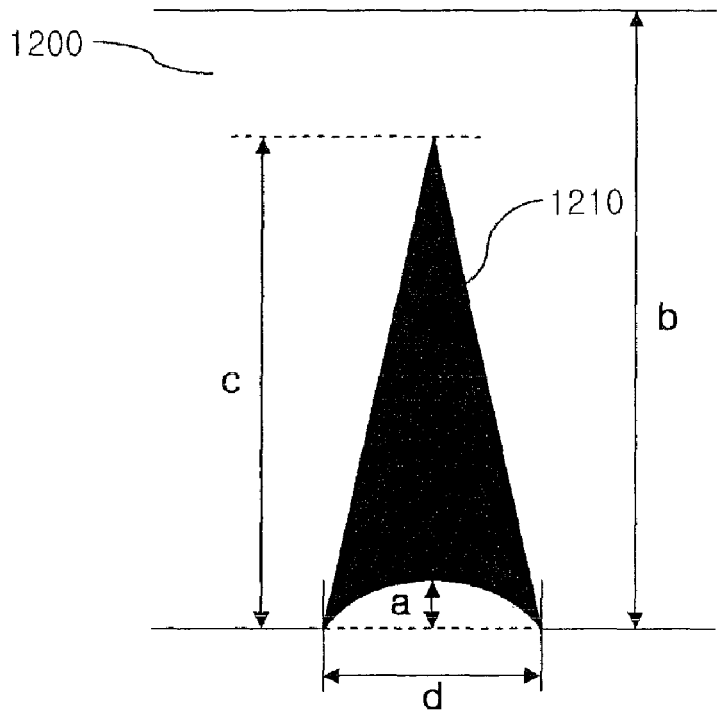

FIG. 24 is a cross-sectional view illustrating the shape of the pattern units having a concave shape at the lower end according to the embodiment of the present invention. Table 1 presents experimental results about the bleeding phenomenon of the display images according to the depth a of the groove of the width d of the pattern units 1210, that is, Table 1 presents experimental results about whether the bleeding phenomenon of images is reduced or not compared with the PDP in which the external light shielding panel having flat pattern units is disposed.

TABLE 1

| Depth (a) of groove | Lower end width (d) of pattern unit | Reduction of bleeding phenomenon |
|---|---|---|
| 0.5 μm | 27 μm | X |
| 1.0 μm | 27 μm | X |
| 1.5 μm | 27 μm | ○ |
| 2.0 μm | 27 μm | ○ |
| 2.5 μm | 27 μm | ○ |
| 3.0 μm | 27 μm | ○ |
| 3.5 μm | 27 μm | ○ |
| 4.0 μm | 27 μm | ○ |
| 4.5 μm | 27 μm | ○ |
| 5.0 μm | 27 μm | ○ |
| 5.5 μm | 27 μm | ○ |
| 6.0 μm | 27 μm | ○ |
| 6.5 μm | 27 μm | ○ |
| 7.0 μm | 27 μm | ○ |
| 7.5 μm | 27 μm | X |
| 8.0 μm | 27 μm | X |
| 9.0 μm | 27 μm | X |
| 9.5 μm | 27 μm | X |

As described in Table 1, the sharpness of the display images may be enhanced by reducing the bleeding phenomenon of the display images, when a depth a of the depressed groove formed in the lower end of the pattern units 1210 is 1.5 μm to 7.0 μm.

Also, the depth a formed in the lower end of the pattern units 1210 is preferably 2 μm to 5 μm in consideration of the protection of the pattern units 1210 from the exterior pressure, and the manufacturing facilitation of the pattern units 1210.

As described in the above with reference to FIG. 7, it is possible to ensure an optimum aperture ratio and to maximize external light shielding efficiency, when a lower end width d of the pattern units 1210 is 18 μm to 35 μm, and thus, the lower end width d of the pattern units 1210 is preferably set to 3.6 to 17.5 times greater than a depth a of a groove formed in the lower end of the pattern units 1210.

Meanwhile, it is possible to form a gradient of the slanted surface capable of optimizing the absorption of external light and the reflection of light emitted from the PDP, when a height c of the pattern units 1210 is 80 μm to 170 μm, and thus, the height c of the pattern units 1210 is preferably set to 16 to 85 times greater than the depth a of the groove formed in the lower end of the pattern units 1210.

Also, the thickness b of the sheet for protecting external light is preferably set to 20 to 90 times greater than the depth a of the groove formed in the lower end of the pattern units 1210, because it is possible to obtain the appropriate transmittance of light emitted from the PDP, the absorption and the shielding as well as the durability of the sheet for protecting external light when the thickness b of the sheet for protecting external light is 100 μm to 180 μm.

Figure 25:
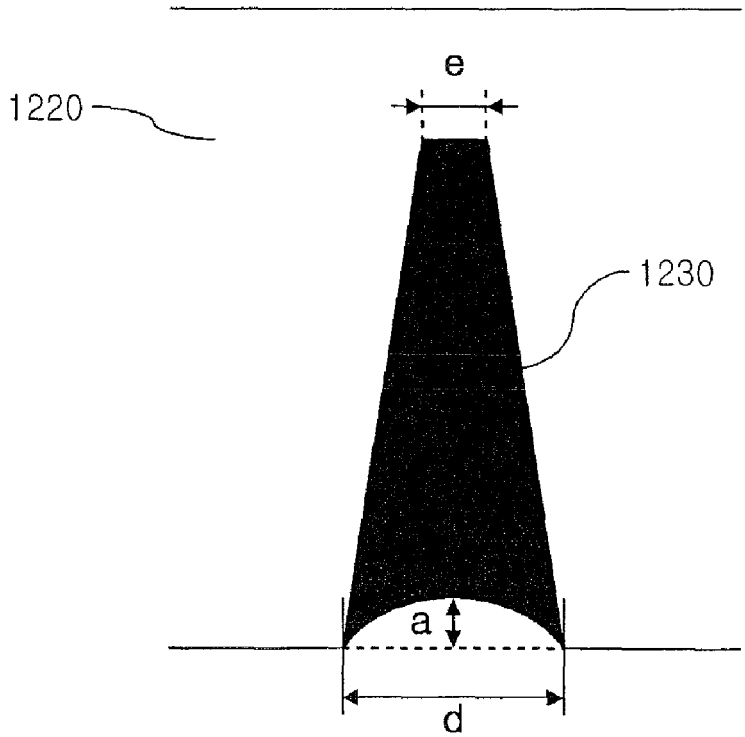

Referring to FIG. 25, the pattern units 1230 may be trapezoidal, and in this case, the upper end width e of the pattern units is preferably less than the lower end width d of the pattern units. Also, when the upper end width e of the pattern units 1230 is 10 μm or less, the slope of the slanted surfaces can be determined according to the relationship between the lower end width d so that the absorption of external light and the reflection of light emitted from the PDP can be optimized. In this case, the relationship between the upper end width e of the pattern units 1230 and the lower end width d of the pattern units 1230 may be the same as shown in FIG. 24.

Figure 26:
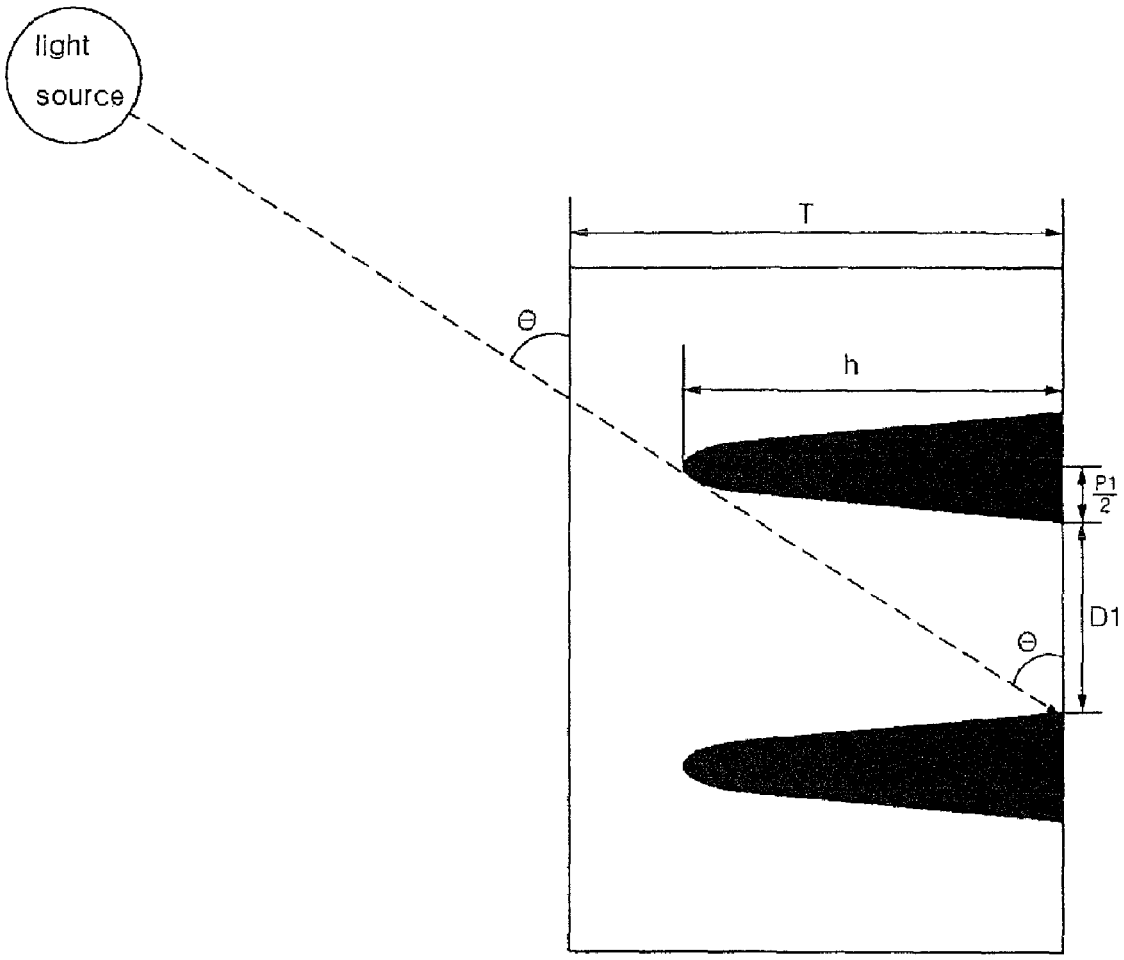
FIG. 26 is a cross-sectional view for explaining the relation between a distance of the adjacent pattern units formed on the sheet for protecting external light and a height of the pattern units.

FIG. 26 is a cross-sectional view illustrating a structure of the sheet for protecting external light to explain the relation between the thickness of the sheet for protecting external light and the height of the pattern units.

Referring to FIG. 26, the thickness T of the sheet for protecting external light is preferably set to 100 μm to 180 μm in order to obtain appropriate transmittance ratio of visible light emitted from the PDP for displaying images as well as to enhance the durability of the sheet for protecting external light including the pattern units.

When the height h of the pattern units provided in the sheet for protecting external light is 80 μm to 170 μm, the manufacture of the pattern units can be facilitated, the optimum aperture ratio of the sheet for protecting external light can be obtained, and the function of shielding external light and the function of reflecting light emitted from the PDP can be maximized.

The height h of the pattern units can be varied according to the thickness T of the sheet for protecting external light. In general, external light that considerably affects the bright room contrast of the PDP is highly likely to be incident upon the PDP from the above. Therefore, in order to effectively shield external light incident upon the PDP at an angle θ within a predetermined range, the height h of the pattern units is preferably within a predetermined percentage of the thickness T of the sheet for protecting external light.

As the height h of the pattern units increases, the thickness of the base unit, which is upper end region of the pattern units, decreases, and thus, dielectric breakdown may occur. On the other hand, as the height h of the pattern units decreases, more external light is likely to be incident upon the PDP at various angles within a predetermined range, and thus the sheet for protecting external light may not properly shield the external light.

Table 2 presents experimental results about the dielectric breakdown and the external light shielding effect of the sheet for protecting external light according to the thickness T of the sheet for protecting external light and the height h of the pattern units.

TABLE 2

| Thickness (T) of external light shielding sheet | Height (h) of pattern units | Dielectric breakdown | External light shielding |
|---|---|---|---|
| 120 μm | 120 μm | ○ | ○ |
| 120 μm | 115 μm | Δ | ○ |
| 120 μm | 110 μm | X | ○ |
| 120 μm | 105 μm | X | ○ |
| 120 μm | 100 μm | X | ○ |
| 120 μm | 95 μm | X | ○ |
| 120 μm | 90 μm | X | ○ |
| 120 μm | 85 μm | X | Δ |
| 120 μm | 80 μm | X | Δ |
| 120 μm | 75 μm | X | Δ |
| 120 μm | 70 μm | X | Δ |
| 120 μm | 65 μm | X | Δ |
| 120 μm | 60 μm | X | Δ |
| 120 μm | 55 μm | X | Δ |
| 120 μm | 50 μm | X | X |

Referring to Table 2, when the thickness T of the sheet for protecting external light is 120 μm or more, and the height h of the pattern units is 115 μm or more, the pattern units are highly likely to dielectric breakdown, thereby increasing defect rates of the product. When the height h of the pattern units is 115 μm or less, the pattern units are less likely to dielectric breakdown, thereby reducing defect rates of the sheet for protecting external light. However, when the height h of the pattern units is 85 μm or less, the shielding efficiency of external light may be reduced, and when the height h of the pattern units is 60 μm or less, external light is likely to be directly incident upon the PDP. Therefore, when the height h of the pattern units is 90 μm to 110 μm, the shielding efficiency of the sheet for protecting external light may be increased as well as the defect rates of the sheet for protecting external light may be decreased.

In addition, when the thickness T of the sheet for protecting external light is 1.01 to 2.25 times greater than the height h of the pattern units, it is possible to prevent the upper end portion of the pattern units 1210 from dielectrically breaking down and to prevent external light from being incident upon the PDP. Also, in order to prevent dielectric breakdown and infiltration of external light into the PDP, to increase the reflection of light emitted from the PDP, and to secure optimum viewing angles, the thickness T of the sheet for protecting external light may be 1.01 to 1.5 times greater than the height h of the pattern units.

Table 3 presents experimental results about the occurrence of the moire phenomenon and the external light shielding effect of the sheet for protecting external light according to different pattern unit lower end width of the sheet for protecting external light-to-bus electrode width ratios, formed on the upper substrate of the PDP, when the width of the bus electrode is 70 μm.

TABLE 3

| Lower end width of pattern units/Width of bus electrodes | Moire | External light shielding |
|---|---|---|
| 0.10 | Δ | X |
| 0.15 | Δ | X |
| 0.20 | X | Δ |
| 0.25 | X | ○ |
| 0.30 | X | ○ |
| 0.35 | X | ○ |
| 0.40 | X | ○ |
| 0.45 | Δ | ○ |
| 0.50 | Δ | ○ |
| 0.55 | ○ | ○ |
| 0.60 | ○ | ○ |

Referring to Table 3, when the lower end width of the pattern units is 0.2 to 0.5 times greater than the bus electrode width, the moire phenomenon can be reduced as well as external light incident upon the PDP can be reduced. Also, in order to prevent the moire phenomenon, to effectively shield external light, and to secure a sufficient aperture ratio for discharging light emitted from the PDP, the lower end width of the pattern units is preferably 0.25 to 0.4 times greater than the bus electrode width.

Table 4 presents experimental results about the occurrence of the moire phenomenon and the external light shielding effect according to different pattern unit lower end width of the sheet for protecting external light-to-vertical barrier rib width ratios, formed on the lower substrate of the PDP, when the width of the vertical barrier rib is 50 μm.

TABLE 4

| Lower end widths of pattern units/Upper end width of vertical barrier ribs | Moire | External light shielding |
|---|---|---|
| 0.10 | ○ | X |
| 0.15 | Δ | X |
| 0.20 | Δ | X |
| 0.25 | Δ | X |
| 0.30 | X | Δ |
| 0.35 | X | Δ |
| 0.40 | X | ○ |
| 0.45 | X | ○ |
| 0.50 | X | ○ |
| 0.55 | X | ○ |
| 0.60 | X | ○ |
| 0.65 | X | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 4, when the lower end width of the pattern units is 0.3 to 0.8 times greater than the upper end width of the vertical barrier rib, the moire phenomenon can be reduced as well as external light incident upon the PDP can be reduced. Also, in order to prevent the moire phenomenon, to effectively shield external light, and to secure a sufficient aperture ratio for discharging light emitted from the PDP, the lower end width of the pattern units is preferably 0.4 to 0.65 times greater than the upper end width of the vertical barrier rib.

FIGS. 27 to 30 are cross-sectional views of embodiments of a structure of a filter according to the present invention. The filter formed on the front surface of the display panel may include an AR/NIR sheet, an EMI shielding sheet, a sheet for protecting external light, an optical property sheet, etc.

Figure 27:
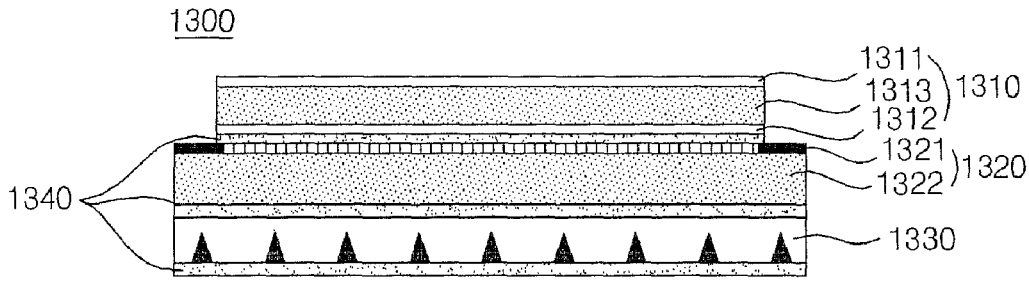
FIGS. 27 to 30 are cross-sectional views showing embodiments of a structure of a filter including a sheet for protecting external light.
Figure 28:
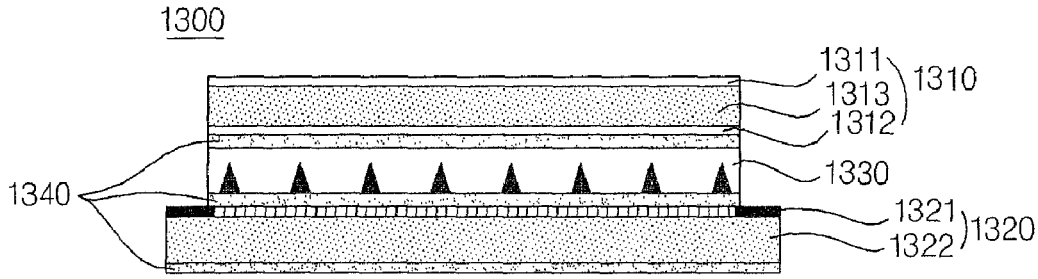

Referring to FIGS. 27 and 28, an AN/NIR sheet 1310 includes an anti-reflection (AR) layer 1311 attached to a front surface of a base sheet 1313 formed of transparent plastic material that has a function of reducing a glare phenomenon by preventing light incident from the external from being reflected and a near infrared shielding sheet 1312 attached to a rear surface thereof that has a function of normally transferring signals transferred using infrared rays such as a remote controller, etc., by shielding near infrared rays emitted from the panel.

An EMI shielding sheet 1320 includes an EMI shielding sheet 1321 attached to a front surface of a base sheet 1322 that has a function of preventing electromagnetic interference (EMI) emitted from the panel from being emitted to the outside by shielding the EMI. At this time, the EMI shielding sheet 1321 is generally formed in a mesh structure using conductive materials and an entire non-efficient display region of the EMI shielding sheet 1320 not displaying an image is coated with conductive materials in order to make a ground smoothly.

Most of an external light source generally exists on an upper end of an viewer's head. The sheet for protecting external light can make a black image of the display panel darker by effectively shielding the external light.

Adhesives 1340 are formed in a layer between the AR/NIR sheet 1310, the EMI shielding sheet 1320, and the sheet for protecting external light 1330 so that each sheet 1310, 1320, and 1330 and the filter 1300 may firmly be attached to the front surface of the panel. Also, it is preferable that the material of the base sheet included between each sheet 1310, 1320, and 1330 is substantially the same in consideration of the manufacturing easiness of the filter.

On the other hand, in FIG. 27, the AN/NIR sheet 1310, the EMI shielding sheet 1320, and the sheet 1330 for protecting external light are stacked in order. However, as shown in FIG. 28, the AN/NIR sheet 1310, the sheet 1330 for protecting external light, and the EMI shielding sheet 1320 may be in order. In other words, the stacking order of each sheet may be different by means of those skilled in the art. Also, at least any one of the sheets 1310, 1320, and 1330 shown may be omitted.

Figure 29:
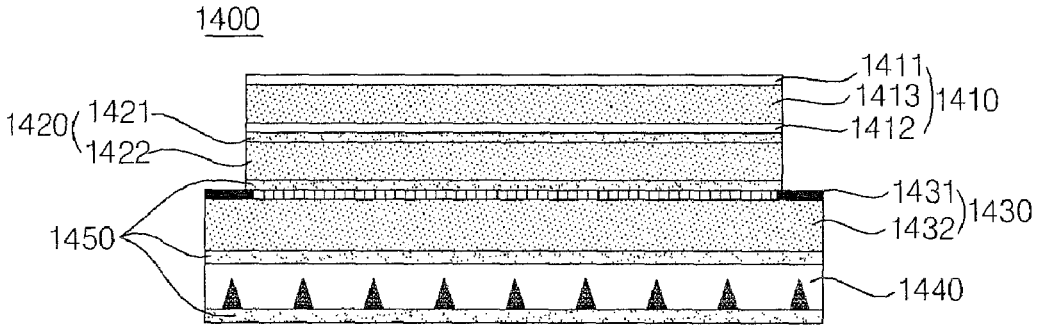
Figure 30:
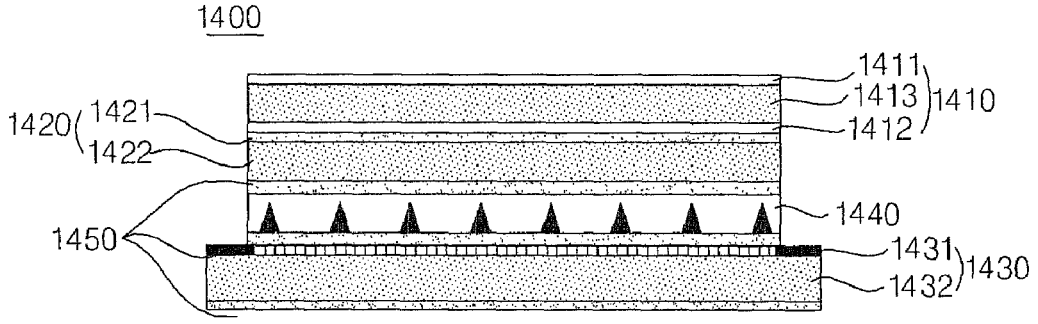

Referring to FIGS. 29 and 30, a filter 1400 formed on a front surface of the panel may further include an optical property sheet 1420 in addition to an AR/NIR sheet 1410, an EMI shielding sheet 1430, and a sheet 1440 for protecting external light. The optical property sheet 1420 improves color temperature and luminance characteristic of light incident from the panel and includes an optical property layer 1421 formed of predetermined dye and adhesive which is stacked on a front surface or a rear surface of a base sheet 1422 formed of a transparent plastic material.

At least any one of the base sheets shown in FIGS. 27 to 30 may be omitted and any one of the base sheets may improve a function of protecting the panel by using a solid glass, not using the plastic material. Preferably, the glass is formed to be spaced at a predetermined interval from the panel.

Also, the filter according to the present invention may further include a diffusion sheet. The diffusion sheet performs a role of diffusing the incident light in order to make the light uniform brightness. Therefore, the diffusion sheet uniformly diffuses the light emitted from the panel, making it possible to widen up and down viewing angles of the display screen and hide the pattern formed on the sheet for protecting external light, etc. Also, the diffusion sheet collects light in a direction corresponding to the up and down viewing angles, making it possible to make front luminance uniform and improve anti-static.

As the diffusion sheet, a transmission type or a reflection type diffusion film may be used. Generally, the diffusion sheet may have a mixed form of small glass bead granules on the base sheet formed of polymer materials. Also, as the base sheet of the diffusion sheet, high purity acrylic resin may be used. In the case of using the high purity acrylic resin, a thickness of the sheet is thicker, while it has good heat resistance so that it may be used for a large display device generating a lot of heat.

As described above, the filter including the sheet for protecting external light according to the present invention may be formed in a film filer type by using the adhesive and otherwise, may be formed in a glass filter type disposed to be spaced from the panel, including the glass.

While the present invention has been particularly shown and described with reference to exemplary embodiments thereof, it will be understood by those of ordinary skill in the art that various changes in form and details may be made therein without departing from the spirit and scope of the present invention as defined by the following claims. It is, therefore, intended that such changes and modifications be covered by the following claims.

What is claimed is:

1. A plasma display device including:

a plasma display panel including an upper substrate, a dielectric layer formed on the upper substrate, a lower substrate, and barrier ribs formed on the lower substrate to partition discharge cells; and a filter disposed on a front surface of the panel, the filter including:

a first base layer;

a second base layer with refractive index smaller than that of the first base layer; and a sheet for protecting external light including a plurality of pattern units formed to be spaced from each other between the first and second base layers, wherein an interval between two pattern units adjacent each other of the plurality of pattern units is larger than a height of the pattern unit.

2. The plasma display device of claim 1, wherein the interval between the two pattern units adjacent each other of the plurality of pattern units is 1.1 to 2 times greater than the height of the pattern unit.

3. The plasma display device of claim 1, wherein the second base layer of the first and second base layers is disposed to be closer to the panel.

4. The plasma display device of claim 1, wherein the height of the pattern unit is 80 μm to 170 μm.

5. The plasma display device of claim 1, wherein the interval between the two pattern units adjacent each other is 88 μm to 340 μm.

6. The plasma display device of claim 1, wherein the interval between the two pattern units adjacent each other is 2.5 to 18.9 times greater than a lower end width of the pattern unit.

7. The plasma display device of claim 1, wherein the refractive index of the second base layer is 1.0 to 1.2.

8. The plasma display device of claim 1, wherein the refractive index of the first base layer is 1.2 to 2.0 times greater than the refractive index of the second base layer.

9. The plasma display device of claim 1, wherein a difference in the refractive index of the first and second base layer is 0.2 to 1.0.

10. The plasma display device of claim 1, wherein the second base layer is an air layer.

11. The plasma display device of claim 1, wherein the refractive index of the pattern unit and the first base layer is substantially the same.

12. The plasma display device of claim 1, wherein the refractive index of the pattern unit is larger than that of the first base layer and a difference in the refractive index of the pattern unit and the first base layer is 0.05 to 0.3.

13. The plasma display device of claim 1, wherein an upper end with a small width of the upper end and lower end of the pattern unit is disposed to be closer to the panel.

14. A filter disposed on a front surface of a display panel, the filter including:

a first base layer;

a second base layer having refractive index smaller than that of the first base layer; and a sheet for protecting external light including a plurality of pattern units formed to be spaced from each other between the first and second base layers, wherein an interval between two pattern units adjacent each other of the plurality of pattern units is larger than a height of the pattern unit.

15. The filter of claim 14, wherein the interval between the two pattern units adjacent each other of the plurality of pattern units is 1.1 to 2 times greater than the height of the pattern unit.

16. The filter of claim 14, wherein the second base layer of the first and second base layers is disposed to be closer to the panel.

17. The filter of claim 14, wherein the refractive index of the first base layer is 1.2 to 2.0 times greater than the refractive index of the second base layer.

18. The filter of claim 14, wherein the second base layer is an air layer.

19. The filter of claim 14, wherein the refractive index of the pattern unit and the first base layer is substantially the same.

20. The filter of claim 14, wherein the refractive index of the pattern unit is larger than that of the first base layer and a difference in the refractive index of the pattern unit and the first base layer is 0.05 to 0.3.

* * * * *